US006906012B1

(12) United States Patent
Saini et al.

(10) Patent No.: US 6,906,012 B1
(45) Date of Patent: Jun. 14, 2005

(54) DETERGENT COMPOSITIONS COMPRISING A FRAGRANT REACTION PRODUCT

(75) Inventors: Gaurav Saini, Kobe (JP); Kimihiro Nakano, Kobe (JP)

(73) Assignee: Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 10/129,676

(22) PCT Filed: Nov. 9, 1999

(86) PCT No.: PCT/US99/26580

§ 371 (c)(1),
(2), (4) Date: May 8, 2002

(87) PCT Pub. No.: WO01/34752

PCT Pub. Date: May 17, 2001

(51) Int. Cl.[7] ..... C11D 3/50
(52) U.S. Cl. ..... 510/101; 512/4
(58) Field of Search ..... 510/475, 476, 510/101, 499; 512/20, 21, 4; 560/35; 564/163

(56) References Cited

U.S. PATENT DOCUMENTS

| | | | | |
|---|---|---|---|---|
| 3,971,852 | A | 7/1976 | Brenner et al. | |
| 4,775,720 | A | 10/1988 | Mookherjee et al. | |
| 4,948,597 | A | 8/1990 | Mookherjee et al. | |
| 5,143,900 | A | 9/1992 | Steltenkamp et al. | |
| 5,270,379 | A * | 12/1993 | McAndrew et al. | 524/555 |
| 5,789,010 | A | 8/1998 | Behan et al. | |
| 6,413,920 | B1 | 7/2002 | Bettiol et al. | |
| 6,451,751 | B1 * | 9/2002 | Busch et al. | 510/349 |
| 6,511,948 | B1 * | 1/2003 | Bettiol et al. | 510/101 |
| 6,566,312 | B2 * | 5/2003 | Bettiol et al. | 510/102 |
| 2003/0134772 | A1 | 7/2003 | Dykstra et al. | |
| 2003/0153474 | A1 | 8/2003 | Bettiol et al. | |
| 2003/0158079 | A1 | 8/2003 | Dykstra et al. | |

FOREIGN PATENT DOCUMENTS

| | | |
|---|---|---|
| EP | 0 430 315 A | 6/1991 |
| EP | 0 634 485 A | 1/1995 |
| EP | 0 841 391 A | 5/1998 |
| EP | 0 971 021 A1 | 1/2000 |
| EP | 0 971 024 A | 1/2000 |
| EP | 0 971 025 A1 | 1/2000 |
| EP | 0 971 026 A1 | 1/2000 |
| EP | 0 971 027 A1 | 1/2000 |
| EP | 1 067 116 A1 | 1/2001 |
| EP | 1 067 173 A1 | 1/2001 |
| EP | 1 067 174 A1 | 1/2001 |
| EP | 1 111 034 A1 | 6/2001 |
| WO | WO 97/06235 A | 2/1997 |
| WO | WO 00/00580 A1 | 1/2000 |
| WO | WO 00/02981 A2 | 1/2000 |
| WO | WO 00/02982 A2 | 1/2000 |
| WO | WO 01/46373 A1 | 6/2001 |
| WO | WO 01/51599 A1 | 7/2001 |
| WO | WO 00/02987 A2 | 1/2002 |
| WO | WO 00/02991 A1 | 1/2002 |

* cited by examiner

*Primary Examiner*—John R. Hardee
(74) *Attorney, Agent, or Firm*—James F. McBride; Kim W. Zerby; Steve W. Miller

(57) ABSTRACT

A detergent composition that includes a fragment reaction product, having a Dry Surface Odor Index of more than 5, is disclosed. Such fragment reaction product can be produced by reacting a primary amine compound and a perfume component selected from the group consisting of $C_6$–$C_{14}$ aliphatic aldehydes, $C_6$–$C_{14}$ acylic terpene aldehydes and mixtures thereof.

12 Claims, No Drawings

DETERGENT COMPOSITIONS COMPRISING A FRAGRANT REACTION PRODUCT

FIELD OF THE INVENTION

The present invention relates to detergent compositions comprising a fragrant reaction product. Particularly, the present invention relates to detergent compositions comprising a fragrant reaction product produced by reacting an amine and a perfume component.

BACKGROUND OF THE INVENTION

Laundry and cleaning products are well-known in the art. However, consumer acceptance of these products is determined not only by the performance achieved with these products but also by the aesthetics associated therewith. The perfume components are therefore an important aspect of the successful formulation of such commercial products.

Consumers prefer that the laundered fabrics maintain the pleasing fragrance over time. When wearing these fabrics, they may feel comfortable if the fragrance lasts a long time. Indeed, perfume additives make laundry compositions more aesthetically pleasing to the consumer, and in some cases the perfume imparts a pleasant fragrance to fabrics treated therewith.

Further, after drying fabrics under the sun, fabrics obtain a "sun-dried type" of odor. Consumers often prefer this to a standard perfume odor. Also they often consider fabrics with these odors to be cleaner. Because consumers like the odor, they like to dry fabrics under the sun. In some countries, however, consumer cannot dry their fabrics outside because the air is not clean, or there is too much rain. As a result, they have to dry their fabrics indoors and cannot expect to enjoy this benefit of having a "sun-dried type" of odor on their fabrics.

A detergent composition comprising a perfume which can provide a "sun-dried type" of odor has now been found.

SUMMARY OF THE INVENTION

The present invention relates to a detergent composition comprising a fragrant reaction product produced by reacting a primary amine compound and a perfume component which is selected from the group consisting of C6–C12 aliphatic aldehydes, C6–C12 acyclic terpene aldehydes and mixtures thereof, wherein the primary amine compound has an Odor Intensity Index that is less than the Odor Intensity Index of a 1% solution of methylanthranilate in dipropylene glycol, and the fragrant reaction product has a Dry Surface Odor Index of more than 5.

In a second aspect of the present invention, there is provided a detergent composition comprising from about 1% to about 60% by weight of a detersive surfactant, from about 0% to about 60% by weight of a detergent builder and from about 0.0001% to about 10% by weight of a fragrant reaction product produced by reacting a primary amine compound and a perfume component wherein the primary amine compound has an Odor Intensity Index less than the Odor Intensity Index of a 1% solution of methyanthranilate in dipropylene glycol, and the fragrant reaction product has a Dry Surface Odor Index of more than 5.

In another aspect of the present invention, there is provided a detergent composition comprising a fragrant reaction product produced by reacting a primary amine compound and a perfume component which is selected from the group consisting of C6–C14 aliphatic aldehydes, C6–C14 acyclic terpene aldehydes and mixtures thereof, wherein the primary amine compound has an Odor Intensity Index less than the Odor Intensity Index of a 1% solution of methylanthranilate in dipropylene glycol, and the fragrant reaction product has a Dry Surface Odor Index of more than 5, and the detergent composition is packed within a closed packaging system having a moisture vapor transmission rate of less than 50 g/m2/24 hours.

DETAILED DESCRIPTION OF THE INVENTION

While the specification concludes with claims particularly pointing out and distinctly claiming the invention, it is believed the present invention will be better understood from the following description.

All percentages are by weight of total composition unless specifically stated otherwise.

All ratios are weight ratios unless specifically stated otherwise.

Definitions

As used herein, "comprising" means that other steps and other ingredients which do not affect the end result can be added. This term encompasses the terms "consisting of " and "consisting essentially of".

All cited references are incorporated herein by reference in their entireties. Citation of any reference is not an admission regarding any determination as to its availability as prior art to the claimed invention.

As used herein, the term "detergent compositions" or "detergent" is intended to designate any of the agents conventionally used for removing soil, such as general household detergents or laundry detergents of the synthetic or soap type.

Fragrant Reaction Product

The present invention is directed to a fragrant reaction products that produces a "sun-dried odor." This fragment reaction product is useful in a cleaning composition for washing a fabric and/or a hard surface. As used herein the term "cleaning composition" includes both a detergent composition which provides a fabric cleaning benefit and a hard surface cleaning benefit. Cleaning compositions are typically used for laundering fabrics and cleaning hard surfaces such as dishes, floors, tiling, bathrooms, toilets, kitchens and other surfaces. The cleaning compositions may comprise from about 0.0001% to about 10%, preferably from about 0.001% to about 5%, and more preferably from about 0.01% to about 2% by weight of the fragrant reaction products of the present invention.

The fragrant reaction product is produced by reacting a compound containing a primary amine compound and a perfume component which is selected from the group consisting of a C6–C14 aliphatic aldehyde, a C6–C14 acyclic terpene aldehyde and a mixture thereof. Preferably, the perfume component is selected from the group consisting of citral; neral; iso-citral; dihydro citral; cironellal; octanal; nonanal; decanal; undecanal; dodecanal; tridecanal; 2-methyl decanal; methyl nonyl acetaldehyde; 2-nonen-1-al; 2-decanal; undecenal; undecylenic aldehyde; 2, 6 dimethyl octanal; 2,6,10-trimethyl-9 undecen-1-al; trimethyl undecanal; dodecenal; melonal; 2-methyl octanal; 3, 5, 5, trimethyl hexanal and a mixture thereof.

When a fabric is washed with a detergent composition containing the fragrant reaction product herein, a "sun dried odor" is produced on a fabric even though the fabric is not actually dried in the sun. The reaction mixture is formed by selecting the starting aldehydes such that at least one of them is present naturally in cotton fabrics after the fabric is dried in the sun and thus, are a component of the sun dried odor.

The fragrant reaction products of this invention can comprise mixtures of various different products produced by different reactions according to the present invention. These mixtures of fragrant reaction products can be made separately and then admixed, or they can be produced simultaneously by reacting one or more primary amine with one or more perfume components. For example, a preferred fragrant reaction products comprises, by weight: 30% of the product of a reaction between ethyl 4-amino benzoate ("EAB") and 2-nonen-1-al; 10% of the product of reaction between EAB and methyl nonyl acetaldehyde; 20% of the product of reaction between EAB and undecylenic aldehyde; 10% of the product of reaction between EAB and lauric aldehyde; and 30% of the product of reaction between EAB and citral.

A Primary Amine

The primary amine compounds suitable for use in the present invention are characterized by their Odor Intensity Index, which is preferably less than the Odor Intensity Index of a 1% solution of methylanthranilate in dipropylene glycol. The primary amine is non-volatile, meaning that the primary amine has a boiling point of at least about 125° C., and preferably of from about 150° C. to about 300° C. The primary amine useful herein also has a molecular weight of at least about 80 g/mol, preferably from about 100 g/mol to about 30,000 g/mol, and more preferably from about 125 g/mol to about 25,000 g/mol. Such boiling point and molecular weight information for a primary amine is easily available from standard texts, or from the supplier of the primary amine. The primary amine useful herein includes primary amines having linear, branched, and/or cyclic chains, and may be saturated, unsaturated, polymeric, or aromatic primary amines. Unsaturated, polymeric, and aromatic primary amines are especially preferred herein. Unsaturated, polymeric, and aromatic primary amines containing both an alkoxy and a carboxylate ester group in their structures are even more preferred. A primary amine possessing multiple reactive amine groups is also useful herein, and preferred.

Preferred polymeric primary amines include polyethyleneimines commercially available as "Lupasols" from BASF, including Lupasol FG (MW 800), G20 wfv (MW 1,300), PR8515 (MW 2,000), WF (MW 25,000), FC (MW 800), G20 (MW 1,300), G35 (MW 1,200), G100 (MW 2,000), HF (MW 25,000), P (MW 750,000), PS (MW 750,000), SK (MW 2,000,000), SNA (MW 1,000,000). Especially preferred primary amines useful herein include meta-, para- and ortho-amino methyl benzoate, n-ethyl amino benzoate, Kymene 557H and Kymene 450 (polymeric amines formed of repeating polyamide and reactive azetidine and epoxide moieties from Hercules), Lupasol HF, and mixtures thereof. Primary amines useful herein are available from, for example, BASF AG (Ludwigschafen, Germany); Bush Boake Allen, Ltd. (London, Great Britain); Haarmann & Reimer GmbH (Holzminden, Germany); and Hercules, Inc. (Wilmington, Del., USA).

Without intending to be limited by theory, it is believed that the free electron pair of the primary amine's nitrogen neucleophilically attacks the carbonyl carbon of the perfume component, in the presence of an acid catalyst, to form the Schiff Base reaction product and water. The acid catalyst acts as a carbonyl activator, which significantly increases the reaction rate. The Schiff Base reaction product has a desirable odor and may be activated by a change in external conditions, such as pH, temperature, and moisture, so as to deliver a high level of odor impact when needed, e.g., when a clothing item is worm. This results in a controlled release of perfume from the laundered item. Accordingly, such perfumes possess distinct advantages over traditional perfumes, which constantly release their scent, until they are depleted. For example, less perfume may be employed, while still providing a consumer-acceptable odor. As perfumes may be very expensive, this may significantly reduce costs.

Furthermore, because of the physical and chemical properties of perfume raw materials, many desirable scents cannot be deposited on fabrics like the sun dry order via traditional perfumes. This way of controlled release facilitates the deposition of such scents on dry fabrics.

Odor Intensity Index Method

As used herein, the term "Odor Intensity Index", is defined by a test whereby the pure chemicals being tested are diluted at 1% by weight in dipropylene glycol, an odor-free solvent. Smelling strips, or so called "blotters", are dipped and presented to an expert panelist for evaluation. The expert panelists are assessors trained for at least six months in odor grading and whose gradings are regularly checked for accuracy and reproducibility versus a reference on an ongoing basis. For each amine compound, the panelist is presented two blotters: one reference (methyl anthranilate, unknown to the panelist) and the sample. The panelst is asked to rank both smelling strips on a 0–5 odor intensity scale, where 0 indicates that no odor is detected, 5 indicates that very strong odor is detected.

The following represents the Odor Intensity Index of an amine compound suitable for use in the present invention, according to the above procedure. In each case, the numbers are arithmetic averages from 5 expert panellists and the results are statistically significant at a 95% confidence level:

| | |
|---|---|
| Methylanthranilate 1% (reference) | 3.4 |
| Ethyl-4-aminobenzoate (EAB) 1% | 0.9 |

B-Perfume

The perfume component of the present invention is selected from the group consisting of C6–C14 aliphatic aldehydes, C6–C14 acyclic terpene aldehyde and mixtures thereof. Preferably, the perfume component of the present invention is selected from C8–C12 aliphatic aldehydes, C8–C12 acyclic terpene aldehydes and mixtures thereof. Most preferably, the perfume component of the present invention is selected from the group consisting of citral; neral; iso-citral; dihydro citral; citronellal; octanal; nonanal; decanal; undecanal; dodecanal; tridecanal; 2-methyl decanal; methyl nonyl acetaldehyde; 2-nonen-1-al; decanal; undecenal; undecylenic aldehyde; 2, 6 dimethyl octanal; 2,6,10-trimethyl-9-undecen-1-al; trimethyl undecanal; dodecenal; melonal; 2-methyl octanal; 3, 5, 5, trimethyl hexanal and mixtures thereof. The preferable mixtures are, for example, a mixture comprising 30% by weight of 2-nonen-1-al, 40% by weight of undecylenic aldehyde and 30% by weight of citral or a mixture comprising 20% by weight of methyl nonyl acetaldehyde, 25% by weight of lauric aldehyde, 35% by weight of decanal and 20% by weight of 2-nonen-1-al.

Isomers of these components are also suitable for use herein.

The cleaning composition of the present invention may further comprise other perfumes. Other perfumes can provide an additional fragrance to the cleaning product and/or can provide a fragrance during a different stage of the washing process. Other perfumes are conventionally added to the cleaning composition as a spray-on component during the manufacturing process. When adding other perfumes, the ratio of the other perfumes to the fragrant reaction product must be controlled. If the cleaning composition comprises too low a proportion of the fragrant reaction product, the desired "sun-dried odor" may not be noticeable. However, if the cleaning composition comprises too low proportion of other perfumes, the cleaning composition may not have a high enough overall odor impact. The weight ratio of the other perfumes to fragrant reaction product useful herein is from about 100:1 to about 16:100. Preferably, the ratio is from about 30:1 to about 1:5.

C-Process

Preparation of the fragrant reaction product is as follows. The primary amine compound reacts with perfume components and yield "imine". The imine can easily be prepared by a condensation reaction between a primary amine compound and a carbonyl compound in the perfume component.

A typical reaction profile is as follows:

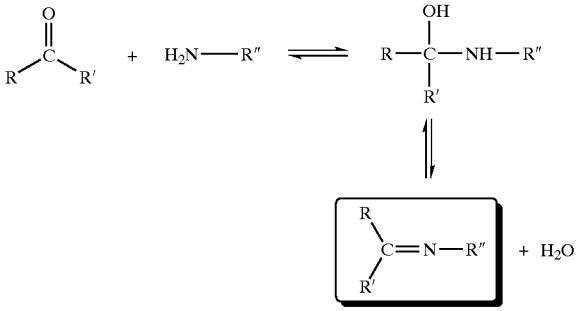

α,β-unsaturated ketones do not only condense with an amine to form imines, but can also further undergo a competitive 1,4-addition to form a β-aminoketones.

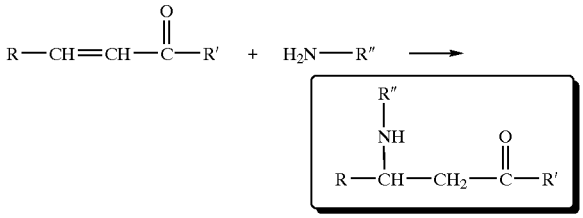

By means of this simple method, compound and composition containing said compounds are made which achieve a delayed release of the active ingredient.

While not required herein, it is highly preferred that the perfume ingredient is present in an equimolar amount to the reactive amine group.

D-Release Mechanism

The present invention provides for a delayed release of the perfume component. While not intending to be bound by theory, it is believed that the release occurs by the following mechanisms:

For an imine compound, the perfume components are released by breaking the imine bond, leading to the release of the perfume component from the primary amine compound. This can be achieved by either hydrolysis, photochemical cleavage, oxidative cleavage, or enzymatic cleavage in fabric or hard surface.

The release of the perfume component may be accelerated by, for example, ironing, tumble-drying, and/or wearing the treated fabric.

E. Dry Surface Odor Intensity Index

The fragrant reaction product(s) of reaction between the primary amine compound and the perfume component provides a dry surface Odor Intensity Index of more than 5, preferably at least 10.

By Dry Surface Odor Index, it is meant that the product of reaction provides a Delta of more than 5, wherein Delta is the difference between the Odor Index of the dry surface treated with the product(s) of the present invention and the Odor Index of the dry surface treated with only the perfume raw material.

For the above Dry Surface Odor Index, the product of the present invention suitable for use in the present invention needs to fulfill at least one of the following two tests. Preferred the product of the present invention suitable for use in the present invention fulfill both test.

For the test sample: 20 g of the cleaning composition herein, having a total fragrant reaction product level of 0.1% by weight was added to a 30 liter twin tub clothes washing machine. Two 100% cotton terry-cloth swatches were added to the washing machine. The remainder of the 1.3 kg laundry load was formed of cotton T-shirts, bath towels, and acrylic fabrics. The load was washed in 30° C. water, according to the regular washing cycle.

For the control, a cleaning composition containing the same weight level of an unreacted perfume component was used, on two control swatches. The cleaning composition dosage, fabric load, washing cycle, etc. for the control and the sample are otherwise identical.

Within 45 min to 1 hour after the end of the washing cycle, one of the fabric swatches is hung on a line and dried for 24 hours, away from any possible contamination. Unless specified, all drying takes place indoors. During drying, the ambient conditions are at a temperature between 18–25° C. and between 40–80% humidity. The other fabric swatch is placed in a tumble drier and undergoes a 15 min drying cycle, and put aside until 24 hours later.

Odor is assessed by an expert panelist who smells and grades the fabrics. A 0–100 scale is used for all fabric odor gradings. The grading scale is as follows:

100=extremely strong perfume odor
75=very strong perfume odor
50=strong odor
40=moderate perfume odor
30=slight perfume odor
20=weak perfume odor
10=very weak perfume odor
0=no odor A difference of more than 5 grades after one day and/or 7 days between (a cleaning composition containing) the fragrant reaction product and (a cleaning composition containing) the unreacted perfume component is statistically significant. A difference of 10 grades or more after one day and/or 7 days represents a step-change. In other words, the fragrant reaction product useful herein has a difference of at least 5 grades, preferably at least 10 grades, from the unreacted perfume component after 24 hours. Incorporation of the fragrant reaction production the cleaning compositions can conveniently be carried out, if necessary, by conventional means. Preferably, the fragrant reaction product is sprayed-onto, encapsulated and added to, dry added to, or agglomerated with a scented or unscented product base. The encapsulated fragrant reaction product may be encapsulated, e.g. as described in GB 1 464 616, or in cyclodextrin. Agglomeration preferably take place with a non-ionic surfactant and sodium carbonate. Preferably, the fragrant reaction product is pre-formed before incorporation into the cleaning compositions. In other words, the perfume component and the amine compound are first reacted together to obtain the fragrant reaction product and the incorporated into the cleaning compositions. Pre-forming allows one to better control the yield, quantity, purity, etc. of the fragrant reaction product, and avoids undesirable side reactions.

F. Closed Packaging System

The detergent of the present invention is preferably packed within a closed packaging system having a moisture vapour transmission rate of less than about 40 g/m2/24 hours. The moisture vapour transmission rate is preferable less than about 30 g/m2/24 hours, and more preferably, less than about 20 g/m2/24 hours.

A closed packaging system may help maintain the fragrant reaction production a stable condition in the cleaning composition. A lower moisture vapour transmission rate reduces undesirable reverse reactions which may occur. These reverse reactions may cause changes in the cleaning composition's appearances and/or odor, and reduce its ability to provide an optimal sun-dried odor impact on dry fabrics.

Any appropriate packaging material can be used for the closed packaging system. Preferably, the packaging material is selected from the group consisting of polyethylene, polypropylene, polyethylene terephthalate (PET), laminated paper, coated paper, sandwich paper, aluminium and the like.

Detersive Surfactant

The detergent compositions of the present invention includes surfactants wherein the surfactant can be selected from the group consisting of nonionic and/or anionic and/or cationic and/or ampholytic and/or zwitterionic and/or semipolar surfactants.

The surfactant is typically present at a level of from about 0.01% to about 60% by weight. More preferred levels of incorporation are from about 1% to about 35% by weight, most preferably from about 1% to about 30% by weight of detergent compositions in accord with the invention.

The surfactant is preferably formulated to be compatible with enzyme components present in the composition. In liquid or gel compositions the surfactant is most preferably formulated such that it promotes, or at least does not degrade, the stability of any enzyme in these compositions.

Preferred surfactants to be used according to the present invention comprise as a surfactant one or more of the nonionic and/or anionic surfactants described herein.

Polyethylene, polypropylene, and polybutylene oxide condensates of alkyl phenols are suitable for use as the nonionic surfactant of the present invention, with the polyethylene oxide condensates being preferred. These compounds include the condensation products of alkyl phenols having an alkyl group containing from about 6 to about 14 carbon atoms, preferably from about 8 to about 14 carbon atoms, in either a straight-chain or branched-chain configuration with the alkylene oxide. In a preferred embodiment, the ethylene oxide is present in an amount equal to from about 2 to about 25 moles, more preferably from about 3 to about 15 moles, of ethylene oxide per mole of alkyl phenol. Commercially available nonionic surfactants of this type include Igepal™ CO-630, marketed by the GAF Corporation; and Triton™ X-45, X-114, X-100 and X-102, all marketed by the Rohm & Haas Company. These surfactants are commonly referred to as alkylphenol alkoxylates (e.g., alkyl phenol ethoxylates).

The condensation products of primary and secondary aliphatic alcohols with from about 1 to about 25 moles of ethylene oxide are suitable for use as the nonionic surfactant of the nonionic surfactant s of the present invention. The alkyl chain of the aliphatic alcohol can either be straight or branched, primary or secondary, and generally contains from about 8 to about 22 carbon atoms. Preferred are the condensation products of alcohol having an alkyl group containing from about 8 to about 20 carbon atoms, more preferably from about 10 to about 18 carbon atoms, with from about 2 to about 10 moles of ethylene oxide per mole of alcohol. About 2 to about 7 moles of ethylene oxide and most preferably from 2 to 5 moles of ethylene oxide per mole of alcohol are present in said condensation products. Examples of commercially available nonionic surfactants of this type include Tergitol™ 15-S-9 (the condensation product of $C_{11}$–$C_{15}$ linear alcohol with 9 moles ethylene oxide), Tergitol™ 24-L6 NMW (the condensation product of $C_{12}$–$C_{14}$ primary alcohol with 6 moles ethylene oxide with a narrow molecular weight distribution), both marketed by Union Carbide Corporation; Neodol™ 45-9 (the condensation product of $C_{14}$–$C_{15}$ linear alcohol with 9 moles of ethylene oxide), Neodol™ 23-3 (the condensation product of $C_{12}$–$C_{13}$ linear alcohol with 3.0 moles of ethylene oxide), Neodol™ 45-7 (the condensation product of $C_{14}$–$C_{15}$ linear alcohol with 7 moles of ethylene oxide), Neodol™ 45-5 (the condensation product of $C_{14}$–$C_{15}$ linear alcohol with 5 moles of ethylene oxide) marketed by Shell Chemical Company, Kyro™ EOB (the condensation product of $C_{13}$–$C_{15}$ alcohol with 9 moles ethylene oxide), marketed by The Procter & Gamble Company, and Genapol LA O3 O or O5 O (the condensation product of $C_{12}$–$C_{14}$ alcohol with 3 or 5 moles of ethylene oxide) marketed by Hoechst. Preferred range of HLB in these products is from 8–11 and most preferred from 8–10.

Also useful nonionic surfactants of the present invention are the alkylpolysaccharides disclosed in U.S. Pat. No. 4,565,647, Llenado, issued Jan. 21, 1986, having a hydrophobic group containing from about 6 to about 30 carbon atoms, preferably from about 10 to about 16 carbon atoms and a polysaccharide, e.g. a polyglycoside, hydrophilic group containing from about 1.3 to about 10, preferably from about 1.3 to about 3, most preferably from about 1.3 to about 2.7 saccharide units. Any reducing saccharide containing 5 or 6 carbon atoms can be used, e.g., glucose, galactose and galactosyl moieties can be substituted for the glucosyl moieties (optionally the hydrophobic group is attached at the 2-, 3-, 4, etc. positions thus giving a glucose or galactose as opposed to a glucoside or galactoside). The intersaccharide bonds can be, e.g., between the one position of the additional saccharide units and the 2-, 3-, 4, and/or 6-positions on the preceding saccharide units.

The preferred alkylpolyglycosides have the formula $$R^2O(C_n H_{2n} O)_t(\text{glycosyl})_x$$

wherein $R^2$ is selected from the group consisting of alkyl, alkylphenyl, hydroxyalkyl, hydroxyalkylphenyl, and mixtures thereof in which the alkyl groups contain from about 10 to about 18, preferably from about 12 to about 14, carbon atoms; n is 2 or 3, preferably 2; t is from 0 to about 10, preferably 0; and x is from about 1.3 to about 10, preferably from about 1.3 to about 3, most preferably from about 1.3 to about 2.7. The glycosyl is preferably derived from glucose. To prepare these compounds, the alcohol or alkylpolyethoxy alcohol is formed first and then reacted with glucose, or a source of glucose, to form the glucoside (attachment at the 1-position). The additional glycosyl units can then be attached between their 1-position and the preceding glycosyl units 2-, 3-, 4- and/or 6-position, preferably predominately the 2-position.

The condensation products of ethylene oxide with a hydrophobic base formed by the condensation of propylene oxide with propylene glycol are also suitable for use as the additional nonionic detersive surfactant of the present invention. The hydrophobic portion of these compounds will preferably have a molecular weight of from about 1500 to about 1800 and will exhibit water insolubility. The addition of polyoxyethylene moieties to this hydrophobic portion tends to increase the water solubility of the molecule as a whole, and the liquid character of the product is retained up to the point where the polyoxyethylene content is about 50% of the total weight of the condensation product, which corresponds to condensation with up to about 40 moles of thylene oxide. Examples of compounds of this type include certain of the commercially-available Plurafac™ LF404 and Pluronic™ surfactants, marketed by BASF.

Also suitable for use as the nonionic surfactant of the present invention, are the condensation products of ethylene oxide with the product resulting from the reaction of propylene oxide and ethylenediamine. The hydrophobic moiety of these products consists of the fragrant reaction product of ethylenediamine and excess propylene oxide, and generally has a molecular weight of from about 2500 to about 3000. This hydrophobic moiety is condensed with ethylene oxide to the extent that the condensation product contains from about 40% to about 80% by weight of polyoxyethylene and has a molecular weight of from about 5,000 to about 11,000. Examples of this type of nonionic surfactant include certain of the commercially available Tetronic™ compounds, marketed by BASF.

Preferred for use as the nonionic surfactant of the present invention are polyethylene oxide condensates of alkyl phenols, condensation products of primary and secondary aliphatic alcohols with from about 1 to about 25 moles of ethylene oxide, alkylpolysaccharides, and mixtures thereof. Most preferred are $C_8$–$C_{14}$ alkyl phenol ethoxylates having from 3 to 15 ethoxy-groups and $C_8$–$C_{18}$ alcohol ethoxylates (preferably $C_{10}$ avg.) having from 2 to 10 ethoxy groups, and mixtures thereof.

Highly preferred nonionic surfactants are polyhydroxy fatty acid amide surfactants of the formula.

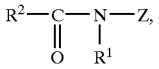

wherein $R^1$ is H, or $R^1$ is $C_{1-4}$ hydrocarbyl, 2-hydroxy ethyl, 2-hydroxy propyl or a mixture thereof, $R^2$ is $C_{5-31}$ hydrocarbyl, and Z is a polyhydroxyhydrocarbyl having a linear hydrocarbyl chain with at least 3 hydroxyls directly connected to the chain, or an alkoxylated derivative thereof. Preferably, $R^1$ is methyl, $R^2$ is a straight $C_{11-15}$ alkyl or $C_{16-18}$ alkyl or alkenyl chain such as coconut alkyl or mixtures thereof, and Z is derived from a reducing sugar such as glucose, fructose, maltose, lactose, in a reductive amination reaction.

Suitable anionic surfactants to be used are linear alkyl benzene sulfonate, alkyl ester sulfonate, branched alkyl sulfonate, mid-branched alkyl sulfonate surfactants including linear esters of $C_8$–$C_{20}$ carboxylic acids (i.e., fatty acids) which are sulfonated with gaseous $SO_3$ according to "The Journal of the American Oil Chemists Society", 52 (1975), pp. 323–329. Suitable starting materials would include natural fatty substances as derived from tallow, palm oil, etc.

The preferred alkyl ester sulfonate surfactant, especially for laundry applications, comprise alkyl ester sulfonate surfactants of the structural formula:

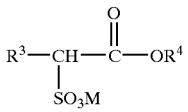

wherein $R^3$ is a $C_8$–$C_{20}$ hydrocarbyl, preferably an alkyl, or combination thereof, $R^4$ is a $C_1$–$C_6$ hydrocarbyl, preferably an alkyl, or combination thereof, and M is a cation which forms a water soluble salt with the alkyl ester sulfonate. Suitable salt-forming cations include metals such as sodium, potassium, and lithium, and substituted or unsubstituted ammonium cations, such as monoethanolamine, diethanolamine, and triethanolamine. Preferably, $R^3$ is $C_{10}$–$C_{16}$ alkyl, and $R^4$ is methyl, ethyl or isopropyl. Especially preferred are the methyl ester sulfonates wherein $R^3$ is $C_{10}$–$C_{16}$ alkyl.

Other suitable anionic surfactants include the alkyl sulfate surfactants which are water soluble salts or acids of the formula $ROSO_3M$ wherein R preferably is a $C_{10}$–$C_{24}$ hydrocarbyl, preferably an alkyl or hydroxyalkyl having a $C_{10}$–$C_{20}$ alkyl component, more preferably a $C_{12}$–$C_{18}$ alkyl or hydroxyalkyl, and M is H or a cation, e.g., an alkali metal cation (e.g. sodium, potassium, lithium), or ammonium or substituted ammonium (e.g. methyl-, dimethyl-, and trimethyl ammonium cations and quaternary ammonium cations such as tetramethyl-ammonium and dimethyl piperdinium cations and quaternary ammonium cations derived from alkylamines such as ethylamine, diethylamine, triethylamine, and mixtures thereof, and the like). Typically, alkyl chains of $C_{12}$–$C_{16}$ are preferred for lower wash temperatures (e.g. below about 50° C.) and $C_{16-18}$ alkyl chains are preferred for higher wash temperatures (e.g. above about 50° C.).

Other anionic surfactants useful for detersive purposes can also be included in the detergent compositions of the present invention. These can include salts (including, for example, sodium, potassium, ammonium, and substituted ammonium salts such as mono-, di- and triethanolamine salts) of soap, $C_8$–$C_{22}$ primary of secondary alkanesulfonates, $C_8$–$C_{24}$ olefinsulfonates, sulfonated polycarboxylic acids prepared by sulfonation of the pyrolyzed product of alkaline earth metal citrates, e.g., as described in British patent specification No. 1,082,179, $C_8$–$C_{24}$ alkylpolyglycolethersulfates (containing up to 10 moles of ethylene oxide); alkyl glycerol sulfonates, fatty acyl glycerol sulfonates, fatty oleyl glycerol sulfates, alkyl phenol ethylene oxide ether sulfates, paraffin sulfonates, alkyl phosphates, isethionates such as the acyl isethionates, N-acyl taurates, alkyl succinamates and sulfosuccinates, monoesters of sulfosuccinates (especially saturated and unsaturated $C_{12}$–$C_{18}$ monoesters) and diesters of sulfosuccinates (especially saturated and unsaturated $C_6$–$C_{12}$ diesters), acyl sarcosinates, sulfates of alkylpolysaccharides such as the sulfates of alkylpolyglucoside (the nonionic nonsulfated compounds being described below), branched primary alkyl sulfates, and alkyl polyethoxy carboxylates such as those of the formula $RO(CH_2CH_2O)_k$-$CH_2COO$-M+ wherein R is a $C_8$–$C_{22}$ alkyl, k is an integer from 1 to 10, and M is a soluble salt-forming cation. Resin acids and hydrogenated resin acids are also suitable, such as resin, hydrogenated resin, and resin acids and hydrogenated resin acids present in or derived from tall oil.

Further examples are described in "Surface Active Agents and Detergents" (Vol. I and II by Schwartz, Perry and Berch). A variety of such surfactants, are also generally disclosed in U.S. Pat. No. 3,929,678, issued Dec. 30, 1975 to Laughlin, et al. at Column 23, line 58 through Column 29, line 23 (herein incorporated by reference).

When included therein, the detergent compositions of the present invention typically comprise from about 1% to about 40%, preferably from about 3% to about 20% by weight of such anionic surfactants.

Highly preferred anionic surfactants include alkyl alkoxylated sulfate surfactants hereof are water soluble salts or acids of the formula $RO(A)_m$ SO3M wherein R is an unsubstituted $C_{10}$–$C_{24}$ alkyl or hydroxyalkyl group having a $C_{10}$–$C_{24}$ alkyl component, preferably a $C_{12}$–$C_{20}$ alkyl or hydroxyalkyl, more preferably $C_{12}$–$C_{18}$ alkyl or hydroxyalkyl, A is an ethoxy or propoxy unit, m is greater than zero, typically between about 0.5 and about 6, more preferably between about 0.5 and about 3, and M is H or a cation which can be, for example, a metal cation (e.g., sodium, potassium, lithium, calcium, magnesium, etc.), ammonium or substituted-ammonium cation. Alkyl ethoxylated sulfates as well as alkyl propoxylated sulfates are contemplated herein. Specific examples of substituted ammonium cations include methyl-, dimethyl, trimethylammonium cations and quaternary ammonium cations such as tetramethyl-ammonium and dimethyl piperdinium cations and those derived from alkylamines such as ethylamine, diethylamine, triethylamine, mixtures thereof, and the like. Exemplary surfactants are $C_{12}$–$C_{18}$ alkyl polyethoxylate (1.0) sulfate ($C_{12}$–$C_{18}$ E(1.0)M), $C_{12}$–$C_{18}$ alkyl polyethoxylate (2.25) sulfate ($C_{12}$–$C_{18}$ E(2.25)M), $C_{12}$–$C_{18}$ alkyl polyethoxylate (3.0) sulfate ($C_{12}$–$C_{18}$ E(3.0)M), and $C_{12}$–$C_{18}$ alkyl polyethoxylate (4.0) sulfate ($C_{12}$–$C_{18}$ E(4.0)M), wherein M is conveniently selected from sodium and potassium.

The detergent compositions of the present invention may also contain cationic, ampholytic, zwitterionic, and semipolar surfactants, as well as the nonionic and/or anionic surfactants other than those already described herein.

Cationic detersive surfactants suitable for use in the detergent compositions of the present invention are those having one long-chain hydrocarbyl group. Examples of such cationic surfactants include the ammonium surfactants such as alkyltrimethylammonium halogenides, and those surfactants having the formula:

$$[R^2(OR^3)_y][R^4(OR^3)_y]_2R^5N+X—$$

wherein $R^2$ is an alkyl or alkyl benzyl group having from about 8 to about 18 carbon atoms in the alkyl chain, each $R^3$ is selected from the group consisting of —$CH_2CH_2$—, —$CH_2CH(CH_3)$—, —$CH_2CH(CH_2OH)$—, —$CH_2CH_2CH_2$—, and mixtures thereof; each $R^4$ is selected from the group consisting of $C_1$–$C_4$ alkyl, $C_1$–$C_4$ hydroxyalkyl, benzyl ring structures formed by joining the two $R^4$ groups, —$CH_2CHOH$—$CHOHCOR^6CHOHCH_2OH$ wherein $R^6$ is any hexose or hexose polymer having a molecular weight less than about 1000, and hydrogen when y is not 0; $R^5$ is the same as $R^4$ or is an alkyl chain wherein the total number of carbon atoms of $R^2$ plus $R^5$ is not more than about 18; each y is from 0 to about 10 and the sum of the y values is from 0 to about 15; and X is any compatible anion.

Quaternary ammonium surfactant suitable for the present invention has the formula (I):

Formula I

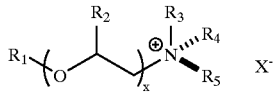

whereby R1 is a short chainlength alkyl (C6–C10) or alkylamidoalkyl of the formula (II):

Formula II

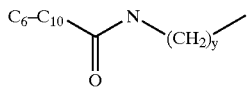

y is 2–4, preferably 3.

whereby R2 is H or a C1–C3 alkyl, whereby x is 0–4, preferably 0–2, most preferably 0, whereby R3, R4 and R5 are either the same or different and can be either a short chain alkyl (C1–C3) or alkoxylated alkyl of the formula III, whereby $X^-$ is a counterion, preferably a halide, e.g. chloride or methylsulfate.

Formula III

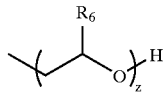

R6 is $C_1$–$C_4$ and z is 1 or 2.

Preferred quaternary ammonium surfactants are those as defined in formula I whereby $R_1$ is $C_8$, $C_{10}$ or mixtures thereof, x=o, $R_3$, $R_4$=$CH_3$ and $R_5$=$CH_2CH_2OH$.

Highly preferred cationic surfactants are the water-soluble quaternary ammonium compounds useful in the present composition having the formula:

$$R_1R_2R_3R_4N^+X^- \quad \text{(i)}$$

wherein $R_1$ is $C_8$–$C_{16}$ alkyl, each of $R_2$, $R_3$ and $R_4$ is independently $C_1$–$C_4$ alkyl, $C_1$–$C_4$ hydroxy alkyl, benzyl, and —$(C_2H_{40})_x$ H where x has a value from 2 to 5, and X is an anion. Not more than one of $R_2$, $R_3$ or $R_4$ should be benzyl.

The preferred alkyl chain length for $R_1$ is $C_{12}$–$C_{15}$ particularly where the alkyl group is a mixture of chain lengths derived from coconut or palm kernel fat or is derived synthetically by olefin build up or OXO alcohols synthesis. Preferred groups for $R_2R_3$ and $R_4$ are methyl and hydroxyethyl groups and the anion X may be selected from halide, methosulphate, acetate and phosphate ions.

Examples of suitable quaternary ammonium compounds of formulae (i) for use herein are:

- coconut trimethyl ammonium chloride or bromide;
- coconut methyl dihydroxyethyl ammonium chloride or bromide;
- decyl triethyl ammonium chloride;
- decyl dimethyl hydroxyethyl ammonium chloride or bromide;
- $C_{12\text{-}15}$ dimethyl hydroxyethyl ammonium chloride or bromide;
- coconut dimethyl hydroxyethyl ammonium chloride or bromide;
- myristyl trimethyl ammonium methyl sulphate;
- lauryl dimethyl benzyl ammonium chloride or bromide;

lauryl dimethyl (ethenoxy)$_4$ ammonium chloride or bromide;

choline esters (compounds of formula (i) wherein $R_1$ is $CH_2—CH_2—O—C(=O)—C_{12-14}$ alkyl and $R_2R_3R_4$ are methyl).

di-alkyl imidazolines [compounds of formula (i)].

Other cationic surfactants useful herein are also described in U.S. Pat. No. 4,228,044, Cambre, issued Oct. 14, 1980 and in European Patent Application EP 000,224.

Typical cationic fabric softening components include the water-insoluble quaternary-ammonium fabric softening actives or thei corresponding amine precursor, the most commonly used having been di-long alkyl chain ammonium chloride or methyl sulfate.

Preferred cationic softeners among these include the following:

1) ditallow dimethylammonium chloride (DTDMAC);
2) dihydrogenated tallow dimethylammonium chloride;
3) dihydrogenated tallow dimethylammonium methylsulfate;
4) distearyl dimethylammonium chloride;
5) dioleyl dimethylammonium chloride;
6) dipalmityl hydroxyethyl methylammonium chloride;
7) stearyl benzyl dimethylammonium chloride;
8) tallow trimethylammonium chloride;
9) hydrogenated tallow trimethylammonium chloride;
10) $C_{12-14}$ alkyl hydroxyethyl dimethylammonium chloride;
11) $C_{12-18}$ alkyl dihydroxyethyl methylammonium chloride;
12) di(stearoyloxyethyl) dimethylammonium chloride (DSOEDMAC);
13) di(tallow-oxy-ethyl) dimethylammonium chloride;
14) ditallow imidazolinium methylsulfate;
15) 1-(2-tallowylamidoethyl)$_2$-tallowyl imidazolinium methylsulfate.

Biodegradable quaternary ammonium compounds have been presented as alternatives to the traditionally used di-long alkyl chain ammonium chlorides and methyl sulfates. Such quaternary ammonium compounds contain long chain alk(en)yl groups interrupted by functional groups such as carboxy groups. Said materials and fabric softening compositions containing them are disclosed in numerous publications such as EP-A-0,040,562, and EP-A-0,239,910.

The quaternary ammonium compounds and amine precursors herein have the formula (I) or (II), below:

(I)

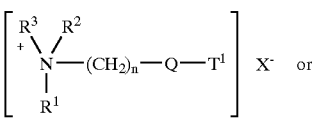

-continued (II)

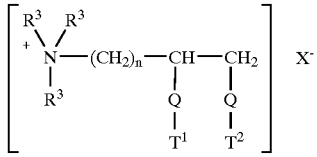

wherein Q is selected from —O—C(O)—, —C(O)—O—, —O—C(O)—O—, —NR$^4$—C(O)—, —C(O)—NR$^4$—;

$R^1$ is $(CH_2)_n$—Q—$T^2$ or $T^3$;

$R^2$ is $(CH_2)_m$—Q—$T^4$ or $T^5$ or $R^3$;

$R^3$ is $C_1$–$C_4$ alkyl or $C_1$–$C_4$ hydroxyalkyl or H;

$R^4$ is H or $C_1$–$C_4$ alkyl or $C_1$–$C_4$ hydroxyalkyl;

$T^1$, $T^2$, $T^3$, $T^4$, $T^5$ are independently $C_1$–$C_{22}$ alkyl or alkenyl;

n and m are integers from 1 to 4; and $X^-$ is a softener-compatible anion. Non-limiting examples of softener-compatible anions include chloride or methyl sulfate.

The alkyl, or alkenyl, chain $T^1$, $T^2$, $T^3$, $T^4$, $T^5$ must contain at least 11 carbon atoms, preferably at least 16 carbon atoms. The chain may be straight or branched. Tallow is a convenient and inexpensive source of long chain alkyl and alkenyl material. The compounds wherein $T^1$, $T^2$, $T^3$, $T^4$, $T^5$ represents the mixture of long chain materials typical for tallow are particularly preferred.

Specific examples of quaternary ammonium compounds suitable for use in the aqueous fabric softening compositions herein include:

1) N,N-di(tallowyl-oxy-ethyl)-N,N-dimethyl ammonium chloride;
2) N,N-di(tallowyl-oxy-ethyl)N-methyl, N-(2-hydroxyethyl) ammonium methyl sulfate;
3) N,N-di(2-tallowyl-oxy-2-oxo-ethyl)-N,N-dimethyl ammonium chloride;
4) N,N-di(2-tallowyl-oxy-ethylcarbonyl-oxy-ethyl)-N,N-dimethyl ammonium chloride;
5) N-(2-tallowyl-oxy-2-ethyl)N-(2-tallowyl-oxy-2 oxo-ethyl)N,N-dimethyl ammonium chloride;
6) N,N,N-tri(tallowyl-oxy-ethyl)N-methyl ammonium chloride;
7) N-(2-tallowyl-oxy-2-oxo-ethyl)-N-(tallowyl-N,N-dimethyl-ammonium chloride; and
8) 1,2-ditallowyl-oxy-3 trimethylammoniopropane chloride;

and mixtures of any of the above materials.

When included therein, the detergent compositions of the present invention typically comprise from 0.2% to about 25%, preferably from about 1% to about 8% by weight of such cationic surfactants.

Ampholytic surfactants are also suitable for use in the detergent compositions of the present invention. These surfactants can be broadly described as aliphatic derivatives of secondary or tertiary amines, or aliphatic derivatives of heterocyclic secondary and tertiary amines in which the aliphatic radical can be straight- or branched-chain. One of the aliphatic substituents contains at least about 8 carbon atoms, typically from about 8 to about 18 carbon atoms, and at least one contains an anionic water-solubilizing group, e.g. carboxy, sulfonate, sulfate. See U.S. Pat. No. 3,929,678 to Laughlin et al., issued Dec. 30, 1975 at column 19, lines 18–35, for examples of ampholytic surfactants.

When included therein, the detergent compositions of the present invention typically comprise from 0.2% to about 15%, preferably from about 1% to about 10% by weight of such ampholytic surfactants.

Zwitterionic surfactants are also suitable for use in detergent compositions. These surfactants can be broadly described as derivatives of secondary and tertiary amines, derivatives of heterocyclic secondary and tertiary amines, or derivatives of quaternary ammonium, quaternary phosphonium or tertiary sulfonium compounds. See U.S. Pat. No. 3,929,678 to Laughlin et al., issued Dec. 30, 1975 at column 19, line 38 through column 22, line 48, for examples of zwitterionic surfactants.

When included therein, the detergent compositions of the present invention typically comprise from 0.2% to about 15%, preferably from about 1% to about 10% by weight of such zwitterionic surfactants.

Semi-polar nonionic surfactants are a special category of nonionic surfactants which include water-soluble amine oxides containing one alkyl moiety of from about 10 to about 18 carbon atoms and 2 moieties selected from the group consisting of alkyl groups and hydroxyalkyl groups containing from about 1 to about 3 carbon atoms; water-soluble phosphine oxides containing one alkyl moiety of from about 10 to about 18 carbon atoms and 2 moieties selected from the group consisting of alkyl groups and hydroxyalkyl groups containing from about 1 to about 3 carbon atoms; and water-soluble sulfoxides containing one alkyl moiety of from about 10 to about 18 carbon atoms and a moiety selected from the group consisting of alkyl and hydroxyalkyl moieties of from about 1 to about 3 carbon atoms.

Semi-polar nonionic detergent surfactants include the amine oxide surfactants having the formula $$R^3(OR^4)_xN^{\rightarrow O}(R^5)_2$$

wherein $R^3$ is an alkyl, hydroxyalkyl, or alkyl phenyl group or mixtures thereof containing from about 8 to about 22 carbon atoms; $R^4$ is an alkylene or hydroxyalkylene group containing from about 2 to about 3 carbon atoms or mixtures thereof; x is from 0 to about 3; and each $R^5$ is an alkyl or hydroxyalkyl group containing from about 1 to about 3 carbon atoms or a polyethylene oxide group containing from about 1 to about 3 ethylene oxide groups. The $R^5$ groups can be attached to each other, e.g., through an oxygen or nitrogen atom, to form a ring structure.

These amine oxide surfactants in particular include $C_{10}$–$C_{18}$ alkyl dimethyl amine oxides and $C_8$–$C_{12}$ alkoxy ethyl dihydroxy ethyl amine oxides.

When included therein, the cleaning compositions of the present invention typically comprise from 0.2% to about 15%, preferably from about 1% to about 10% by weight of such semi-polar nonionic surfactants.

The detergent composition of the present invention may further comprise a cosurfactant selected from the group of primary or tertiary amines. Suitable primary amines for use herein include amines according to the formula $R_1NH_2$ wherein $R_1$ is a $C_6$–$C_{12}$, preferably $C_6$–$C_{10}$ alkyl chain or $R_4X(CH_2)_n$, X is —O—, —C(O)NH— or —NH—, $R_4$ is a $C_6$–$C_{12}$ alkyl chain n is between 1 to 5, preferably 3. $R_1$ alkyl chains may be straight or branched and may be interrupted with up to 12, preferably less than 5 ethylene oxide moieties. Preferred amines according to the formula herein above are n-alkyl amines. Suitable amines for use herein may be selected from 1-hexylamine, 1-octylamine, 1-decylamine and laurylamine. Other preferred primary amines include C8–C10 oxypropylamine, octyloxypropylamine, 2-ethylhexyl-oxypropylamine, lauryl amido propylamine and amido propylamine.

Suitable tertiary amines for use herein include tertiary amines having the formula $R_1R_2R_3N$ wherein R1 and R2 are $C_1$–$C_8$ alkylchains or $$—(CH_2—\overset{R_5}{\overset{|}{CH}}—O)_xH$$

$R_3$ is either a $C_6$–$C_{12}$, preferably $C_6$–$C_{10}$ alkyl chain, or $R_3$ is $R_4X(CH_2)_n$, whereby X is —O—, —C(O)NH— or —NH— $R_4$ is a $C_4$–$C_{12}$, n is between 1 to 5, preferably 2–3. $R_5$ is H or $C_1$–$C_2$ alkyl and x is between 1 to 6.

$R_3$ and $R_4$ may be linear or branched; $R_3$ alkyl chains may be interrupted with up to 12, preferably less than 5, ethylene oxide moieties.

Preferred tertiary amines are $R_1R_2R_3N$ where R1 is a C6–C12 alkyl chain, R2 and R3 are C1–C3 alkyl or $$—(CH_2—\overset{R_5}{\overset{|}{CH}}—O)_xH$$

where R5 is H or CH3 and x=1–2.

Also preferred are the amidoamines of the formula:

$$R_1—\overset{O}{\overset{\|}{C}}—NH—(CH_2)_n—N—(R_2)_2$$

wherein $R_1$ is $C_6$–$C_{12}$ alkyl; n is 2–4, preferably n is 3; $R_2$ and $R_3$ is $C_1$–$C_4$ Most preferred amines of the present invention include 1-octylamine, 1-hexylamine, 1-decylamine, 1-dodecylamine, C8–10 oxypropylamine, N coco 1–3 diaminopropane, coconutalkyldimethylamine, lauryldimethylamine, lauryl bis(hydroxyethyl)amine, coco bis(hydroxyehtyl)amine, lauryl amine 2 moles propoxylated, octyl amine 2 moles propoxylated, lauryl amidopropyldimethylamine, C8–10 amidopropyldimethylamine and C10 amidopropyldimethylamine.

The most preferred amines for use in the compositions herein are 1-hexylamine, 1-octylamine, 1-decylamine, 1-dodecylamine. Especially desirable are n-dodecyldimethylamine and bishydroxyethylcoconutalkylamine and oleylamine 7 times ethoxylated, lauryl amido propylamine and cocoamido propylamine.

Additional Ingredients

Builders

The detergent composition of the present invention can optionally comprise builders.

The level of builder can vary widely depending upon the end use of the composition and its desired physical form. When present, the compositions will typically comprise at least 1% builder, preferably from 1% to 80%. Liquid formulations typically comprise from 5% to 50%, more typically 5% to 30%, by weight, of detergent builder. Granular formulations typically comprise from 1% to 80%, more typically from 5% to 50% by weight, of the detergent builder. Lower or higher levels of builder, however, are not meant to be excluded.

Inorganic or P-containing detergent builders include, but are not limited to, the alkali metal, ammonium and alkanolammonium salts of polyphosphates (exemplified by the tripolyphosphates, pyrophosphates, and glassy polymeric meta-phosphates), phosphonates, phytic acid, silicates, carbonates (including bicarbonates and sesquicarbonates), sulphates, and aluminosilicates. However, non-phosphate builders are required in some locales. Importantly, the compositions herein function surprisingly well even in the presence of the so-called "weak" builders (as compared with phosphates) such as citrate, or in the so-called "underbuilt" situation that may occur with zeolite or layered silicate builders.

Examples of silicate builders are the alkali metal silicates, particularly those having a $SiO_2$:$Na_2O$ ratio in the range 1.0:1 to 3.2:1 and layered silicates, such as the layered sodium silicates described in U.S. Pat. No. 4,664,839. NaSKS-6 is the trademark for a crystalline layered silicate marketed by Hoechst (commonly abbreviated herein as "SKS-6"). Unlike zeolite builders, the Na SKS-6 silicate builder does not contain aluminum. NaSKS6 has the delta-$Na_2SiO_5$ morphology form of layered silicate. It can be prepared by methods such as those described in DE-A-3,417,649 and DE-A-3,742,043. SKS-6 is a highly preferred layered silicate for use herein, but other such layered silicates, such as those having the general formula $NaMSi_xO_{2x+1}.yH_2O$ wherein M is sodium or hydrogen, x is a number from 1.9 to 4, preferably 2, and y is a number from 0 to 20, preferably 0 can be used herein. Various other layered silicates from Hoechst include NaSKS5, NaSKS-7 and NaSKS-11, as the alpha, beta and gamma forms. As noted above, the delta-$Na_2SiO_5$ (NaSKS-6 form) is most preferred for use herein. Other silicates may also be useful such as for example magnesium silicate, which can serve as a crispening agent in granular formulations, as a stabilizing agent for oxygen bleaches, and as a component of suds control systems.

Examples of carbonate builders are the alkaline earth and alkali metal carbonates as disclosed in DE 2,321,001.

Aluminosilicate builders are useful in the present invention. Aluminosilicate builders are of great importance in most currently marketed heavy duty granular detergent compositions, and can also be a significant builder ingredient in liquid detergent formulations. Aluminosilicate builders include those having the empirical formula:

$$M_{z/n}[(AlO_2)_z(SiO_2)_y].xH_2O$$

wherein z and y are integers usually of at least 6, the molar ratio of z to y is in the range from 1.0 to 0, and x is an integer from 0 to 264, and M is a Group IA or IIA element, e.g., Na, K, Mg, Ca with valence n.

Useful aluminosilicate ion exchange materials are commercially available. These aluminosilicates can be crystalline or amorphous in structure and can be naturally-occurring aluminosilicates or synthetically derived. A method for producing aluminosilicate ion exchange materials is disclosed in U.S. Pat. No. 3,985,669. Preferred synthetic crystalline aluminosilicate ion exchange materials useful herein are available under the designations Zeolite A, Zeolite P (B), Zeolite MAP and Zeolite X. In an especially preferred embodiment, the crystalline aluminosilicate ion exchange material has the formula:

$$Na_{12}[(AlO_2)_{12}(SiO_2)_{12}].xH_2O$$

wherein x is from 20 to 30, especially 27. This material is known as Zeolite A. Dehydrated zeolites (x=0–10) may also be used herein. Preferably, the aluminosilicate has a particle size of 0.1–10 microns in diameter.

Organic detergent builders suitable for the purposes of the present invention include, but are not restricted to, a wide variety of polycarboxylate compounds. As used herein, "polycarboxylate" refers to compounds having a plurality of carboxylate groups, preferably at least 3 carboxylates. Polycarboxylate builder can generally be added to the composition in acid form, but can also be added in the form of a neutralized salt. When utilized in salt form, alkali metals, such as sodium, potassium, and lithium, or alkanolammonium salts are preferred.

Included among the polycarboxylate builders are a variety of categories of useful materials. One important category of polycarboxylate builders encompasses the ether polycarboxylates, including oxydisuccinate, as disclosed in Berg, U.S. Pat. No. 3,128,287, U.S. Pat. No. 3,635,830. See also "TMS/TDS" builders of U.S. Pat. No. 4,663,071. Suitable ether polycarboxylates also include cyclic compounds, particularly alicyclic compounds, such as those described in U.S. Pat. Nos. 3,923,679; 3,835,163; 4,158,635; 4,120,874 and 4,102,903.

Other useful detergency builders include the ether hydroxypolycarboxylates, copolymers of maleic anhydride with ethylene or vinyl methyl ether, 1,3,5-trihydroxy benzene-2,4,6-trisulphonic acid, and carboxymethyloxysuccinic acid, the various alkali metal, ammonium and substituted ammonium salts of polyacetic acids such as ethylenediamine tetraacetic acid and nitrilotriacetic acid, as well as polycarboxylates such as mellitic acid, pyromellitic, succinic acid, oxydisuccinic acid, polymaleic acid, benzene 1,3,5-tricarboxylic acid, carboxymethyloxysuccinic acid, and soluble salts thereof.

Citrate builders, e.g., citric acid and soluble salts thereof (particularly sodium salt), are polycarboxylate builders of particular importance for heavy duty liquid detergent formulations due to their availability from renewable resources and their biodegradability. Citrates can also be used in granular compositions, especially in combination with zeolite and/or layered silicate builders. Oxydisuccinates are also especially useful in such compositions and combinations.

Also suitable in the detergent compositions of the present invention are the 3,3-dicarboxy-4 oxa-1,6 hexanedioates and the related compounds disclosed in U.S. Pat. No. 4,566,984. Useful succinic acid builders include the $C_5$–$C_{20}$ alkyl and alkenyl succinic acids and salts thereof. A particularly preferred compound of this type is dodecenylsuccinic acid. Specific examples of succinate builders include: laurylsuccinate, myristylsuccinate, palmitylsuccinate, 2-dodecenylsuccinate (preferred), 2-pentadecenylsuccinate, and the like. Laurylsuccinates are the preferred builders of this group, and are described in EP 0,200,263.

Other suitable polycarboxylates are disclosed in U.S. Pat. No. 4,144,226 and in U.S. Pat. No. 3,308,067. See also U.S. Pat. No. 3,723,322.

Fatty acids, e.g., $C_{12}$–$C_{18}$ monocarboxylic acids such as oleic acid and/or its salts, can also be incorporated into the compositions alone, or in combination with the aforesaid builders, especially citrate and/or the succinate builders, to provide additional builder activity. Such use of fatty acids will generally result in a diminution of sudsing, which should be taken into account by the formulator.

In situations where phosphorus-based builders can be used, and especially in the formulation of bars used for hand-laundering operations, the various alkali metal phosphates such as the well-known sodium tripolyphosphates, sodium pyrophosphate and sodium orthophosphate can be used. Phosphonate builders such as ethane-1-hydroxy-1,1-diphosphonate and other known phosphonates (see, for example, U.S. Pat. Nos. 3,159,581; 3,213,030; 3,422,021; 3,400,148 and 3,422,137) can also be used.

Bleaching Compounds—Bleaching Agents and Bleach Activators

The detergent compositions of herein may optionally contain bleaching agents or bleaching compositions containing a bleaching agent and one or more bleach activators.

When present, bleaching agents will typically be at levels of from 1% to 30%, more typically from 5% to 20%, of the detergent composition, especially for fabric laundering. If present, the amount of bleach activators will typically be from 0.1% to 60%, more typically from 0.5% to 40% of the bleaching composition comprising the bleaching agent-plus-bleach activator.

The bleaching agents used herein can be any of the bleaching agents useful for detergent compositions in textile cleaning or other cleaning purposes that are now known or become known. These include oxygen bleaches as well as other bleaching agents like hypochlorite bleaching agents. Perborate bleaches, e.g., sodium perborate (e.g., mono- or tetra-hydrate) can be used herein. When hypochlorite is used, a highly preferred hypochlorite bleaching component is an alkali metal hypochlorite. Although alkali metal hypochlorites are preferred, other hypochlorite compounds may also be used herein and can be selected from calcium and magnesium hypochlorite. A preferred alkali metal hypochlorite for use herein is sodium hypochlorite.

Another category of bleaching agent that can be used without restriction encompasses percarboxylic acid bleaching agents and salts thereof. Suitable examples of this class of agents include magnesium monoperoxyphthalate hexahydrate, the magnesium salt of metachloro perbenzoic acid, 4-nonylamino-4-oxoperoxybutyric acid and diperoxydodecanedioic acid. Such bleaching agents are disclosed in U.S. Pat. No. 4,483,781, U.S. Pat. No. 740,446, EP 0,133,354, and U.S. Pat. No. 4,412,934. Highly preferred bleaching agents also include 6 nonylamino-6-oxoperoxycaproic acid as described in U.S. Pat. No. 4,634,551.

Peroxygen bleaching agents can also be used. Suitable peroxygen bleaching compounds include sodium carbonate peroxyhydrate and equivalent "percarbonate" bleaches, sodium pyrophosphate peroxyhydrate, urea peroxyhydrate, and sodium peroxide. Persulfate bleach (e.g., OXONE, manufactured commercially by DuPont) can also be used.

A preferred percarbonate bleach comprises dry particles having an average particle size in the range from 500 micrometers to 1,000 micrometers, not more than 10% by weight of said particles being smaller than 200 micrometers and not more than 10% by weight of said particles being larger than 1,250 micrometers. Optionally, the percarbonate can be coated with silicate, borate or water-soluble surfactants. Percarbonate is available from various commercial sources such as FMC, Solvay and Tokai Denka.

Mixtures of bleaching agents can also be used.

Peroxygen bleaching agents, the perborates, the percarbonates, etc., are preferably combined with bleach activators, which lead to the in situ production in aqueous solution (i.e., during the washing process) of the peroxy acid corresponding to the bleach activator. Various non-limiting examples of activators are disclosed in U.S. Pat. No. 4,915,854, and U.S. Pat. No. 4,412,934. The nonanoyloxybenzene sulfonate (NOBS), 3,5,5-tri-methyl hexanoyl oxybenzene sulfonate (ISONOBS) and tetraacetyl ethylene diamine (TAED) activators are typical, and mixtures thereof can also be used. See also U.S. Pat. No. 4,634,551 for other typical bleaches and activators useful herein. Highly preferred amido-derived bleach activators are those of the formulae:

$$R^1\,N(R^5)C(O)R^2C(O)L \text{ or } R^{1\circ}\,C.(O)N(R^5)R^2C(O)L$$

wherein $R^1$ is an alkyl group containing from 6 to 12 carbon atoms, $R^2$ is an alkylene containing from 1 to 6 carbon atoms, $R^5$ is H or alkyl, aryl, or alkaryl containing from 1 to 10 carbon atoms, and L is any suitable leaving group. A leaving group is any group that is displaced from the bleach activator as a consequence of the nucleophilic attack on the bleach activator by the perhydrolysis anion. A preferred leaving group is phenyl sulfonate.

Preferred examples of bleach activators of the above formulae include (6-octanamido-caproyl) oxybenzenesulfonate, (6-nonanamidocaproyl)oxybenzene sulfonate, (6 decanamido-caproyl)oxybenzenesulfonate, and mixtures thereof as described in U.S. Pat. No. 4,634,551, incorporated herein by reference.

Another class of bleach activators comprises the benzoxazin-type activators disclosed by Hodge et al in U.S. Pat. No. 4,966,723. A highly preferred activator of the benzoxazin-type is:

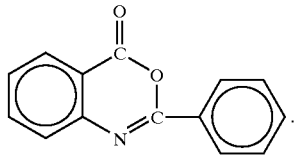

Still another class of preferred bleach activators includes the acyl lactam activators, especially acyl caprolactams and acyl valerolactams of the formulae:

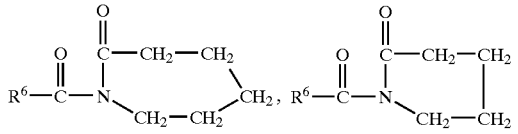

wherein $R^6$ is H or an alkyl, aryl, alkoxyaryl, or alkaryl group containing from 1 to 12 carbon atoms. Highly preferred lactam activators include benzoyl caprolactam, octanoyl caprolactam, 3,5,5-trimethylhexanoyl caprolactam, nonanoyl caprolactam, decanoyl caprolactam, undecenoyl caprolactam, benzoyl valerolactam, octanoyl valerolactam, decanoyl valerolactam, undecenoyl valerolactam, nonanoyl valerolactam, 3,5,5 trimethylhexanoyl valerolactam and mixtures thereof. See also U.S. Pat. No. 4,545,784, issued to Sanderson, Oct. 8, 1985, incorporated herein by reference, which discloses acyl caprolactams, including benzoyl caprolactam, adsorbed into sodium perborate.

Bleaching agents other than oxygen bleaching agents are also known in the art and can be utilized herein. One type of non-oxygen bleaching agent of particular interest includes photoactivated bleaching agents such as the sulfonated zinc and/or aluminum phthalocyanines. See U.S. Pat. No. 4,033,718. If used, detergent compositions will typically contain from 0.025% to 1.25%, by weight, of such bleaches, especially sulfonate zinc phthalocyanine.

If desired, the bleaching compounds can be catalyzed by means of a manganese compound. Such compounds are well-known in the art and include, for example, the manganese-based catalysts disclosed in U.S. Pat. No. 5,246,621, U.S. Pat. No. 5,244,594; U.S. Pat. No. 5,194,416; U.S. Pat. No. 5,114,606; and EP 549,271 A1, 549,272 A1, 544,440 A2, and 544,490 A1; Preferred examples of these catalysts include $Mn^{IV}{}_2(u\text{-}O)_3(1,4,7\text{-trimethyl-}1,4,7\text{-triazacyclononane})_2(PF_6)_2$, $Mn^{III}{}_2\ (u\text{-}O)_1(u\text{-}OAc)_2(1,4,7\text{-trimethyl-}1,4,7\text{-triazacyclononane})_2\text{-}(ClO_4)_2$, $Mn^{IV}{}_4(u\text{-}O)_6(1,4,7\text{-triazacyclononane})_4(ClO_4)_4$, $Mn^{III}\ Mn^{IV}{}_4(u\text{-}O)_1(u\text{-}OAc)_2\text{-}(1,4,7\text{-trimethyl-}1,4,7\text{-triazacyclononane})_2(ClO_4)_3$, $Mn^{IV}(1,4,7\text{-trimethyl-}1,4,7\text{-triazacyclononane})\text{-}(OCH_3)_3$ (PF6), and mixtures thereof. Other metal-based bleach catalysts include those disclosed in U.S. Pat. No. 4,430,243 and U.S. Pat. No. 5,114,611. The use of manganese with various complex ligands to enhance bleaching is also reported in the following U.S. Pat. Nos.: 4,728,455; 5,284,944; 5,246,612; 5,256,779; 5,280,117; 5,274,147; 5,153,161; and 5,227,084.

As a practical matter, and not by way of limitation, the compositions and processes herein can be adjusted to provide on the order of at least one part per ten million of the active bleach catalyst species in the aqueous washing liquor, and will preferably provide from 0.1 ppm to 700 ppm, more preferably from 1 ppm to 500 ppm, of the catalyst species in the laundry liquor.

Brightners

The compositions herein can also optionally contain from 0.005% to 5% by weight of certain types of hydrophilic optical brighteners which also provide a dye transfer inhibition action. If used, the compositions herein will preferably comprise from 0.001% to 1% by weight of such optical brighteners. The hydrophilic optical brighteners useful in the present invention are those having the structural formula:

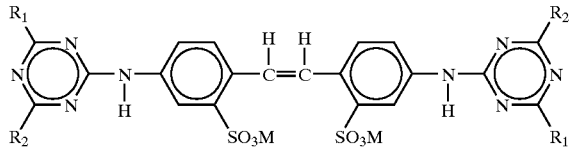

wherein $R_1$ is selected from anilino, N-2-bis-hydroxyethyl and NH-2-hydroxyethyl; $R_2$ is selected from N-2-bis-hydroxyethyl, N-2-hydroxyethyl-N-methylamino, morphilino, chloro and amino; and M is a salt-forming cation such as sodium or potassium.

When in the above formula, $R_1$ is anilino, $R_2$ is N-2-bis-hydroxyethyl and M is a cation such as sodium, the brightener is 4,4',-bis[(4-anilino-6-(N-2 bis-hydroxyethyl)-s-triazine-2-yl)amino]-2,2'-stilbenedisulfonic acid and disodium salt. This particular brightener species is commercially marketed under the tradename Tinopal-UNPA-GX® by Ciba-Geigy Corporation. Tinopal-UNPA-GX is the preferred hydrophilic optical brightener useful in the rinse added compositions herein.

When in the above formula, $R_1$ is anilino, $R_2$ is N-2-hydroxyethyl-N-2-methylamino and M is a cation such as sodium, the brightener is 4,4'-bis[(4-anilino-6-(N-2-hydroxyethyl-N-methylamino)-s-triazine-2-yl)amino]2,2'-stilbenedisulfonic acid disodium salt. This particular brightener species is commercially marketed under the tradename Tinopal 5 BM-GX® by Ciba-Geigy Corporation.

When in the above formula, $R_1$ is anilino, $R_2$ is morphilino and M is a cation such as sodium, the brightener is 4,4'-bis[(4-anilino6 morphilino-s-triazine-2-yl)amino]2,2'-stilbenedisulfonic acid, sodium salt. This particular brightener species is commercially marketed under the tradename Tinopal AMS-GX® by Ciba Geigy Corporation.

Soil Release Agent

In the present invention, an optional soil release agent can be added. Typical levels of incorporation in the composition are from 0% to 10%, preferably from 0.2% to 5%, of a soil release agent. Preferably, such a soil release agent is a polymer.

Soil Release agents are desirably used in fabric softening compositions of the instant invention. Any polymeric soil release agent known to those skilled in the art can optionally be employed in the compositions of this invention. Polymeric soil release agents are characterized by having both hydrophilic segments, to hydrophilize the surface of hydrophobic fibers, such as polyester and nylon, and hydrophobic segments, to deposit upon hydrophobic fibers and remain adhered thereto through completion of washing and rinsing cycles and, thus, serve as an anchor for the hydrophilic segments. This can enable stains occurring subsequent to treatment with the soil release agent to be more easily cleaned in later washing procedures.

If utilized, soil release agents will generally comprise from about 0.01% to about 10.0%, by weight, of the detergent compositions herein, typically from about 0.1% to about 5%, preferably from about 0.2% to about 3.0%.

The following, all included herein by reference, describe soil release polymers suitable for use in the present invention. U.S. Pat. No. 3,959,230 Hays, issued May 25, 1976; U.S. Pat. No. 3,893,929 Basadur, issued Jul. 8, 1975; U.S. Pat. No. 4,000,093, Nicol, et al., issued Dec. 28, 1976; U.S. Pat. No. 4,702,857 Gosselink, issued Oct. 27, 1987; U.S. Pat. No. 4,968,451, Scheibel et al., issued November 6; U.S. Pat. No. 4,702,857, Gosselink, issued Oct. 27, 1987; U.S. Pat. No. 4,711,730, Gosselink et al., issued Dec. 8, 1987; U.S. Pat. No. 4,721,580, Gosselink, issued Jan. 26, 1988; U.S. Pat. No. 4,877,896, Maldonado et al., issued Oct. 31, 1989; U.S. Pat. No. 4,956,447, Gosselink et al., issued Sep. 11, 1990; U.S. Pat. No. 5,415,807 Gosselink et al., issued May 16, 1995; European Patent Application 0 219 048, published Apr. 22, 1987 by Kud, et al.

Further suitable soil release agents are described in U.S. Pat. No. 4,201,824, Violland et al.; U.S. Pat. No. 4,240,918 Lagasse et al.; U.S. Pat. No. 4,525,524 Tung et al.; U.S. Pat. No. 4,579,681, Ruppert et al.; U.S. Pat. No. 4,240,918; U.S. Pat. No. 4,787,989; U.S. Pat. No. 4,525,524; EP 279,134 A, 1988, to Rhone-Poulenc Chemie; EP 457,205 A to BASF (1991); and DE 2,335,044 to Unilever N. V., 1974 all incorporated herein by reference.

Commercially available soil release agents include the METOLOSE SM100, METOLOSE SM200 manufactured by Shin-etsu Kagaku Kogyo K. K., SOKALAN type of material, e.g., SOKALAN HP-22, available from BASF (Germany), ZELCON 5126 (from Dupont) and MILEASE T (from ICI).

Enzyme

The compositions and processes herein can optionally employ one or more enzymes such as lipases, proteases, cellulase, amylases and peroxidases. A preferred enzyme for use herein is a cellulase enzyme. Indeed, this type of enzyme will further provide a color care benefit to the treated fabric. Cellulases usable herein include both bacterial and fungal types, preferably having a pH optimum between 5 and 9.5. U.S. Pat. No. 4,435,307 discloses suitable fungal cellulases from *Humicola insolens* or *Humicola* strain DSM1800 or a cellulase 212-producing fungus belonging to the genus Aeromonas, and cellulase extracted from the hepatopancreas of a marine mollusk, *Dolabella Auricula Solander*. Suitable cellulases are also disclosed in GB-A-2.075.028; GB-A-2.095.275 and DE-OS-2.247.832. CAREZYME® and CELLUZYME® (Novo) are especially useful. Other suitable cellulases are also disclosed in WO 91/17243 to Novo, WO 96/34092, WO 96/34945 and EP-A-0,739,982. In practical terms for current commercial preparations, typical amounts are up to 5 mg by weight, more typically 0.01 mg to 3 mg, of active enzyme per gram of the detergent composition. Stated otherwise, the compositions herein will typically comprise from 0.001% to 5%, preferably 0.01%-1% by weight of a commercial enzyme preparation. In the particular cases where activity of the enzyme preparation can be defined otherwise such as with cellulases, corresponding activity units are preferred (e.g. CEVU or cellulase Equivalent Viscosity Units). For instance, the compositions of the present invention can contain cellulase enzymes at a level equivalent to an activity from 0.5 to 1000 CEVU/gram of composition. Cellulase. enzyme preparations used for the purpose of formulating the compositions of this invention typically have an activity comprised between 1,000 and 10,000 CEVU/gram in liquid form, around 1,000 CEVU/gram in solid form.

Other preferred optional ingredients include enzyme stabilisers, polymeric soil release agents, materials effective for inhibiting the transfer of dyes from one fabric to another during the cleaning process (i.e., dye transfer inhibiting agents), polymeric dispersing agents, suds suppressors, optical brighteners or other brightening or whitening agents, chelating agents, fabric softening clay, anti-static agents, other active ingredients, carriers, hydrotropes, processing aids, dyes or pigments, solvents for liquid formulations and solid fillers for bar compositions.

Liquid detergent compositions can contain water and other solvents as carriers. Low molecular weight primary or secondary alcohols exemplified by methanol, ethanol, propanol, and isopropanol are suitable. Monohydric alcohols are preferred for solubilizing surfactant, but polyols such as those containing from 2 to 6 carbon atoms and from 2 to 6 hydroxy groups (e.g., 1,3-propanediol, ethylene glycol, glycerine, and 1,2-propanediol) can also be used. The compositions may contain from 5% to 90%, typically 10% to 50% of such carriers.

Granular detergents can be prepared, for example, by spray-drying (final product density 520 g/l) or agglomerating (final product density above 600 g/l) the Base Granule. The remaining dry ingredients can then be admixed in granular or powder form with the Base Granule, for example in a rotary mixing drum, and the liquid ingredients (e.g. nonionic surfactant and perfume) can be sprayed on.

The detergent compositions herein will preferably be formulated such that, during use in aqueous cleaning operations, the wash water will have a pH of between 6.5 and 11, preferably between 7.5 and 10.5. Laundry products are typically at pH 9–11. Techniques for controlling pH at recommended usage levels include the use of buffers, alkalis, acids, etc., and are well-known to those skilled in the art.

Method of use

Also provided herein is a method for providing a delayed release of active aldehydes which comprises the step of contacting the surface to be treated with a compound or composition of the invention, and thereafter contacting the treated surface with a material, preferably an aqueous medium like moisture or any other means susceptible of releasing the perfume from the amine fragrant reaction product.

By "surface", it is meant any surface onto which the compound can deposit. Typical examples of such material are fabrics, hard surfaces such as dishware, floors, bathrooms, toilet, kitchen and other surfaces in need of a delayed release of perfume aldehydes such as that with litter like animal litter. Preferably, the surface is selected from a fabric, a tile, a ceramic; more preferably is a fabric.

By "delayed release" is meant release of the active component (e.g perfume) over a longer period of time than by the use of the active (e.g., perfume) itself.

EXAMPLES

The following examples further describe and demonstrate the preferred embodiments within the scope of the present invention. The examples are given solely for the purpose of illustration, an are not to be construed as limitations of the present invention since many variations thereof are possible without departing from its spirit and scope.

Abbreviations used in the Following Laundry and Cleaning Composition Examples

In the laundry and cleaning compositions, the abbreviated component identifications have the following meanings:

In the detergent compositions, the abbreviated component identifications have the following meanings:

| | |
|---|---|
| LAS: | Sodium linear $C_{11-13}$ alkyl benzene sulfonate |
| TAS: | Sodium tallow alkyl sulfate |
| CxyAS: | Sodium $C_{1x}$–$C_{1y}$ alkyl sulfate |
| C46SAS: | Sodium $C_{14}$–$C_{16}$ secondary (2,3) alkyl sulfate |
| CxyEzS: | Sodium $C_{1x}$–$C_{1y}$ alkyl sulfate condensed with z moles of ethylene oxide |
| CxyEz: | $C_{1x}$–$C_{1y}$ predominantly linear primary alcohol condensed with an average of z moles of ethylene oxide |
| QAS: | $R_2.N^+(CH_3)_2(C_2H_4OH)$ with $R_2 = C_{12}$–$C_{14}$ |
| QAS 1: | $R_2.N^+(CH_3)_2(C_2H_4OH)$ with $R_2 = C_8$–$C_{11}$ |
| APA: | $C_8$–$C_{10}$ amido propyl dimethyl amine |
| Soap: | Sodium linear alkyl carboxylate derived from an 80/20 mixture of tallow and coconut fatty acids |
| STS: | Sodium toluene sulphonate |
| CFAA: | $C_{12}$–$C_{14}$ (coco) alkyl N-methyl glucamide |
| TFAA: | $C_{16}$–$C_{18}$ alkyl N-methyl glucamide |
| TPKFA: | $C_{12}$–$C_{14}$ topped whole cut fatty acids |
| STPP: | Anhydrous sodium tripolyphosphate |
| TSPP: | Tetrasodium pyrophosphate |
| Zeolite A: | Hydrated sodium aluminosilicate of formula $Na_{12}(AlO_2SiO_2)_{12}.27H_2O$ having a primary particle size in the range from 0.1 to 10 micrometers (weight expressed on an anhydrous basis) |
| NaSKS-6: | Crystalline layered silicate of formula $\delta$-$Na_2Si_2O_5$ |
| Citric acid: | Anhydrous citric acid |
| Borate: | Sodium borate |
| Carbonate: | Anydrous sodium carbonate with a particle size between 200 $\mu$m and 900 $\mu$m |
| Bicarbonate: | Anhydrous sodium bicarbonate with a particle size distribution between 400 $\mu$m and 1200 $\mu$m |
| Silicate: | Amorphous sodium silicate ($SiO_2$:$Na_2O$ = 2.0:1) |
| Sulfate: | Anhydrous sodium sulfate |
| Mg sulfate: | Anhydrous magnesium sulfate |
| Citrate: | Tri-sodium citrate dihydrate of activity 86.4% with a particle size distribution between 425 $\mu$m and 850 $\mu$m |
| MA/AA: | Copolymer of 1:4 maleic/acrylic acid, average molecular weight about 70,000 |
| MA/AA (1): | Copolymer of 4:6 maleic/acrylic acid, average molecular weight about 10,000 |
| AA: | Sodium polyacrylate polymer of average molecular weight 4,500 |
| CMC: | Sodium carboxymethyl cellulose |
| Cellulose ether: | Methyl cellulose ether with a degree of polymerization of 650 available from Shin Etsu Chemicals |
| Protease: | Proteolytic enzyme, having 3.3% by weight of active enzyme, sold by NOVO Industries A/S under the tradename Savinase |
| Protease I: | Proteolytic enzyme, having 4% by weight of active enzyme, as described in WO 95/10591, sold by Genencor Int. Inc. |
| Alcalase: | Proteolytic enzyme, having 5.3% by weight of active enzyme, sold by NOVO Industries A/S |
| Cellulase: | Cellulytic enzyme, having 0.23% by weight of active enzyme, sold by NOVO Industries A/S under the tradename Carezyme |
| Amylase: | Amylolytic enzyme, having 1.6% by weight of active enzyme, sold by NOVO Industries A/S under the tradename Termamyl 120T |
| Lipase: | Lipolytic enzyme, having 2.0% by weight of active enzyme, sold by NOVO Industries A/S under the tradename Lipolase |
| Lipase (1): | Lipolytic enzyme, having 2.0% by weight of active enzyme, sold by NOVO Industries A/S under the tradename Lipolase Ultra |
| Endolase: | Endoglucanase enzyme, having 1.5% by weight of active enzyme, sold by NOVO Industries A/S |
| PB4: | Sodium perborate tetrahydrate of nominal formula |

-continued

| | |
|---|---|
| | $NaBO_2.3H_2O.H_2O_2$ |
| PB1: | Anhydrous sodium perborate bleach of nominal formula $NaBO_2.H_2O_2$ |
| Percarbonate: | Sodium percarbonate of nominal formula $2Na_2CO_3.3H_2O_2$ |
| NOBS: | Nonanoyloxybenzene sulfonate in the form of the sodium salt |
| NAC-OBS: | (6-nonamidocaproyl)oxybenzene sulfonate |
| TAED: | Tetraacetylethylenediamine |
| DTPA: | Diethylene triamine pentaacetic acid |
| DTPMP: | Diethylene triamine penta(methylene phosphonate), marketed by Monsanto under the Tradename Dequest 2060 |
| EDDS: | Ethylenediamine-N,N'-disuccinic acid, (S,S) isomer in the form of its sodium salt. |
| Photoactivated bleach (1): | Sulfonated zinc phthlocyanine encapsulated in dextrin soluble polymer |
| Photoactivated bleach (2): | Sulfonated alumino phthlocyanine encapsulated in dextrin soluble polymer |
| Brightener 1: | Disodium 4,4'-bis(2-sulphostyryl)biphenyl |
| Brightener 2: | Disodium 4,4'-bis(4-anilino-6-morpholino-1.3.5-triazin-2-yl)amino)stilbene-2:2'-disulfonate |
| HEDP: | 1,1-hydroxyethane diphosphonic acid |
| PEGx: | Polyethylene glycol, with a molecular weight of x (typically 4,000) |
| PEO: | Polyethylene oxide, with an average molecular weight of 50,000 |
| TEPAE: | Tetraethylenepentaamine ethoxylate |
| PVI: | Polyvinyl imidosole, with an average molecular weight of 20,000 |
| PVP: | Polyvinylpyrolidone polymer, with an average molecular weight of 60,000 |
| PVNO: | Polyvinylpyridine N-oxide polymer, with an average molecular weight of 50,000 |
| PVPVI: | Copolymer of polyvinylpyrolidone and vinylimidazole, with an average molecular weight of 20,000 |
| QEA: | $bis((C_2H_5O)(C_2H_4O)_n)$-$(CH_3)$—$N^+$—$C_6H_{12}$—$N^+$—$(CH_3)$ $bis((C_2H_5O)$—$(C_2H_4O))_n$, wherein n = from 20 to 30 |
| SRP 1: | Anionically end capped poly esters |
| SRP 2: | Diethoxylated poly(1,2 propylene terephtalate) short block polymer |
| PEI: | Polyethyleneimine with an average molecular weight of 1800 and an average ethoxylation degree of 7 ethyleneoxy residues per nitrogen |
| Silicone antifoam: | Polydimethylsiloxane foam controller with siloxane-oxyalkylene copolymer as dispersing agent with a ratio of said foam controller to said dispersing agent of 10:1 to 100:1 |
| Opacifier: | Water based monostyrene latex mixture, sold by BASF Aktiengesellschaft under the tradename Lytron 621 |
| Wax: | Paraffin wax |
| PA30: | Polyacrylic acid of average molecular weight of between about 4,500–8,000. |
| 480N: | Random copolymer of 7:3 acrylate/methacrylate, average molecular weight about 3,500. |
| Polygel/ carbopol: | High molecular weight crosslinked polyacrylates. |
| Metasilicate: | Sodium metasilicate ($SiO_2$:$Na_2O$ ratio = 1.0). |
| Nonionic: | $C_{13}$–$C_{15}$ mixed ethoxylated/propoxylated fatty alcohol with an average degree of ethoxylation of 3.8 and an average degree of propoxylation of 4.5. |
| Neodol 45-13: | C14–C15 linear primary alcohol ethoxylate, sold by Shell Chemical CO. |
| MnTACN: | Manganese 1,4,7-trimethyl-1,4,7-triazacyclo-nonane. |
| PAAC: | Pentaamine acetate cobalt(III) salt. |
| Paraffin: | Paraffin oil sold under the tradename Winog 70 by Wintershall. |
| NaBz: | Sodium benzoate. |
| BzP: | Benzoyl Peroxide. |
| SCS: | Sodium cumene sulphonate. |
| BTA: | Benzotriazole. |
| PH: | Measured as a 1% solution in distilled water at 20° C.. |

-continued

| | |
|---|---|
| FRP1: | A fragment reaction product (FRP) between ethyl 4-aminobenzoate and Citral as made from Synthesis example I |
| FRP2: | A fragement reaction product (FRP) between paraaminobenzoic acid and Undecanal |
| FRP3: | A fragment reaction product (FRP) between D-glucamine and 2-nonenal as made from Synthesis example II |

The following are synthesis examples of compounds as defined in the present invention:

I-Synthesis of ethyl 4-aminobenzoate with Citral (FRP1)

To an ice cooled stirred solution of 10 g of Citral (0.07 mol) in 35 mL EtOH and molecular sieves (4Å, 20 g) 1 eq of ethyl 4-aminobenzoate was added via an addition funnel. The reaction mixture was stirred under nitrogen atmosphere and protected from light. After 6 days the mixture was filtrated and the solvent was removed. The yield of imine formation is about 90%.

II-Synthesis of D-glucamine with trans-2-nonenal (FRP-3)

To an ice cooled solution of 1 mmol D-glucamine in about 30 mL EtOH and molecular sieves (4Å, 5 g) 1 eq of the trans-2-nonenal was added. The reaction was stirred under nitrogen atmosphere and protected from light. After 3 to 4 days, the molecular sieves and the solvent were removed by filtration and evaporation respectively. The solid imines were obtained in 85 to 90% yield.

Example 1

The following high density granular laundry detergent compositions A to F were prepared in accord with the invention:

| | A | B | C | D | E | F |
|---|---|---|---|---|---|---|
| LAS | 8.0 | 8.0 | 8.0 | 2.0 | 6.0 | 6.0 |
| TAS | — | 0.5 | — | 0.5 | 1.0 | 0.1 |
| C46(S)AS | 2.0 | 2.5 | — | — | — | — |
| C25AS | — | — | — | 7.0 | 4.5 | 5.5 |
| C68AS | 2.0 | 5.0 | 7.0 | — | — | — |
| C25E5 | — | — | 3.4 | 10.0 | 4.6 | 4.6 |
| C25E7 | 3.4 | 3.4 | 1.0 | — | — | — |
| C25E3S | — | — | — | 2.0 | 5.0 | 4.5 |
| QAS | — | 0.8 | — | — | — | — |
| QAS (I) | — | — | — | 0.8 | 0.5 | 1.0 |
| Zeolite A | 18.1 | 18.0 | 14.1 | 18.1 | 20.0 | 18.1 |
| Citric acid | — | — | — | 2.5 | — | 2.5 |
| Carbonate | 13.0 | 13.0 | 27.0 | 10.0 | 10.0 | 13.0 |
| SKS-6 | — | — | — | 10.0 | — | 10.0 |
| Silicate | 1.4 | 1.4 | 3.0 | 0.3 | 0.5 | 0.3 |
| Citrate | — | 1.0 | — | 3.0 | — | — |
| Sulfate | 26.1 | 26.1 | 26.1 | 6.0 | — | — |
| Mg sulfate | 0.3 | — | — | 0.2 | — | 0.2 |
| MA/AA | 0.3 | 0.3 | 0.3 | 4.0 | 1.0 | 1.0 |
| CMC | 0.2 | 0.2 | 0.2 | 0.2 | 0.4 | 0.4 |
| PB4 | 9.0 | 9.0 | 5.0 | — | — | — |
| Percarbonate | — | — | — | — | 18.0 | 18.0 |
| TAED | 1.5 | 0.4 | 1.5 | — | 3.9 | 4.2 |
| NAC-OBS | — | 2.0 | 1.0 | — | — | — |
| DTPMP | 0.25 | 0.25 | 0.25 | 0.25 | — | — |
| SRP 2 | — | — | — | 0.2 | — | 0.2 |
| EDDS | — | 0.25 | 0.4 | — | 0.5 | 0.5 |
| CFAA | — | 1.0 | — | 2.0 | — | — |
| HEDP | 0.3 | 0.3 | 0.3 | 0.3 | 0.4 | 0.4 |
| QEA | — | — | — | 0.2 | — | 0.5 |
| Protease I | — | — | 0.26 | 1.0 | — | — |
| Protease | 0.26 | 0.26 | — | — | 1.5 | 1.0 |
| Cellulase | 0.3 | — | — | 0.3 | 0.3 | 0.3 |
| Amylase | 0.1 | 0.1 | 0.1 | 0.4 | 0.5 | 0.5 |

-continued

| | A | B | C | D | E | F |
|---|---|---|---|---|---|---|
| Lipase (1) | 0.3 | — | — | 0.5 | 0.5 | 0.5 |
| Photoactivated bleach (ppm) | 15 ppm | 15 ppm | 15 ppm | — | 20 ppm | 20 ppm |
| PVNO/PVPVI | — | — | — | 0.1 | — | — |
| Brightener 1 | 0.09 | 0.09 | 0.09 | — | 0.09 | 0.09 |
| Perfume spray on | 0.3 | 0.3 | 0.3 | 0.4 | 0.4 | 0.4 |
| FRP1 | 0.3 | 0.1 | — | — | 0.15 | 0.1 |
| FRP2 | — | — | 0.3 | 0.1 | 0.15 | 0.2 |
| Silicone antifoam | 0.5 | 0.5 | 0.5 | — | 0.3 | 0.3 |
| Misc/minors to 100% | | | | | | |
| Density in g/liter | 850 | 850 | 850 | 850 | 850 | 850 |

Example 2

The following nil bleach-containing detergent formulations of particular use in the washing of coloured clothing, according to the present invention were prepared:

| | G | H | I |
|---|---|---|---|
| Blown Powder | | | |
| Zeolite A | 15.0 | 15.0 | — |
| Sulfate | 0.0 | 5.0 | — |
| LAS | 3.0 | 3.0 | — |
| DTPMP | 0.4 | 0.5 | — |
| CMC | 0.4 | 0.4 | — |
| MA/AA | 4.0 | 4.0 | — |
| Agglomerates | | | |
| C45AS | — | — | 11.0 |
| LAS | 6.0 | 5.0 | — |
| TAS | 3.0 | 2.0 | — |
| Silicate | 4.0 | 4.0 | — |
| Zeolite A | 10.0 | 15.0 | 13.0 |
| CMC | — | — | 0.5 |
| MA/AA | — | — | 2.0 |
| Carbonate | 9.0 | 7.0 | 7.0 |
| Spray On | | | |
| Perfume | 0.3 | 0.3 | 0.5 |
| C45E7 | 4.0 | 4.0 | 4.0 |
| C25E3 | 2.0 | 2.0 | 2.0 |
| PR2 | 0.04(s) | — | — |
| Dry additives | | | |
| MA/AA | — | — | 3.0 |
| NaSKS-6 | — | — | 12.0 |
| Citrate | 10.0 | — | 8.0 |
| Bicarbonate | 7.0 | 3.0 | 5.0 |
| Carbonate | 8.0 | 5.0 | 7.0 |
| PVPVI/PVNO | 0.5 | 0.5 | 0.5 |
| Alcalase | 0.5 | 0.3 | 0.9 |
| Lipase | 0.4 | 0.4 | 0.4 |
| Amylase | 0.6 | 0.6 | 0.6 |
| Cellulase | 0.6 | 0.6 | 0.6 |
| FRP1 | 0.3 | 0.2 | 0.1 |
| Silicone antifoam | 5.0 | 5.0 | 5.0 |
| Sulfate | 0.0 | 9.0 | 0.0 |
| Misc/minors to 100% | 100.0 | 100.0 | 100.0 |
| Density (g/liter) | 700 | 700 | 700 |

Example 3

The following granular detergent formulations were prepared in accord with the invention.

| | J | K | L | M |
|---|---|---|---|---|
| Base granule | | | | |
| Zeolite A | 30.0 | 22.0 | 24.0 | 10.0 |
| Sulfate | 10.0 | 5.0 | 10.0 | 7.0 |
| MA/AA | 3.0 | — | — | — |
| AA | — | 1.6 | 2.0 | — |
| MA/AA (1) | — | 12.0 | — | 6.0 |
| LAS | 14.0 | 10.0 | 9.0 | 20.0 |
| C45AS | 8.0 | 7.0 | 9.0 | 7.0 |
| C45AES | — | 1.0 | 1.0 | — |
| Silicate | — | 1.0 | 0.5 | 10.0 |
| Soap | — | 2.0 | — | — |
| Brightener 1 | 0.2 | 0.2 | 0.2 | 0.2 |
| Carbonate | 6.0 | 9.0 | 10.0 | 10.0 |
| PEG 4000 | — | 1.0 | 1.5 | — |
| DTPA | — | 0.4 | — | — |
| Spray on | | | | |
| C25E9 | — | — | — | 5.0 |
| C45E7 | 1.0 | 1.0 | — | — |
| C23E9 | — | 1.0 | 2.5 | — |
| Perfume | 0.2 | 0.3 | 0.3 | — |
| PR2 | 0.04(s) | — | — | — |
| Dry additives | | | | |
| Carbonate | 5.0 | 10.0 | 18.0 | 8.0 |
| PVPVI/PVNO | 0.5 | — | 0.3 | — |
| Protease | 1.0 | 1.0 | 1.0 | 0.5 |
| Lipase | 0.4 | — | — | 0.4 |
| Amylase | 0.1 | — | — | 0.1 |
| Cellulase | 0.1 | 0.2 | 0.2 | 0.1 |
| NOBS | — | 4.0 | — | 4.5 |
| PB1 | 1.0 | 5.0 | 1.5 | 6.0 |
| Sulfate | 4.0 | 5.0 | — | 5.0 |
| SRP1 | — | 0.4 | — | — |
| FRP1 | 0.3 | — | 0.15 | 0.10 |
| FRP2 | — | 0.3 | 0.15 | 0.20 |
| Sud supressor | — | 0.5 | 0.5 | — |
| Misc/minor to 100% | | | | |

Example 4

The following liquid detergent formulations were prepared in accord with the invention (levels are given as parts per weight).

| | N | O | P | Q | R |
|---|---|---|---|---|---|
| LAS | 11.5 | 8.8 | — | 3.9 | — |
| C25E2.5S | — | 3.0 | 18.0 | — | 16.0 |
| C45E2.25S | 11.5 | 3.0 | — | 15.7 | — |
| C23E9 | — | 2.7 | 1.8 | 2.0 | 1.0 |
| C23E7 | 3.2 | — | — | — | — |
| CFAA | — | — | 5.2 | — | 3.1 |
| TPKFA | 1.6 | — | 2.0 | 0.5 | 2.0 |
| Citric acid (50%) | 6.5 | 1.2 | 2.5 | 4.4 | 2.5 |
| Calcium formate | 0.1 | 0.06 | 0.1 | — | — |
| Sodium formate | 0.5 | 0.06 | 0.1 | 0.05 | 0.05 |
| Sodium cumene sulfonate | 4.0 | 1.0 | 3.0 | 1.18 | — |
| Borate | 0.6 | — | 3.0 | 2.0 | 2.9 |
| Sodium hydroxide | 5.8 | 2.0 | 3.5 | 3.7 | 2.7 |
| Ethanol | 1.75 | 1.0 | 3.6 | 4.2 | 2.9 |
| 1,2 propanediol | 3.3 | 2.0 | 8.0 | 7.9 | 5.3 |
| Monoethanolamine | 3.0 | 1.5 | 1.3 | 2.5 | 0.8 |
| TEPAE | 1.6 | — | 1.3 | 1.2 | 1.2 |
| Protease | 1.0 | 0.3 | 1.0 | 0.5 | 0.7 |
| Lipase | — | — | 0.1 | — | — |
| Cellulase | — | — | 0.1 | 0.2 | 0.05 |
| Amylase | — | — | — | 0.1 | — |
| SRP1 | 0.2 | — | 0.1 | — | — |
| DTPA | — | — | 0.3 | — | — |

-continued

| | N | O | P | Q | R |
|---|---|---|---|---|---|
| PVNO | — | — | 0.3 | — | 0.2 |
| FRP1 | 0.3 | — | — | 0.15 | — |
| FRP2 | — | 0.3 | — | 0.15 | 0.15– |
| FRP3 | — | — | 0.3 | — | 0.15 |
| Brightener 1 | 0.2 | 0.07 | 0.1 | — | — |
| Silicone antifoam | 0.04 | 0.02 | 0.1 | 0.1 | 0.1 |
| Water/minors | | | | | |

Example 5

The following laundry bar detergent compositions were prepared in accord with the invention (levels are given in parts per weight).

| | S | T | U | V | W | X | Y | Z |
|---|---|---|---|---|---|---|---|---|
| LAS | — | — | 19.0 | 15.0 | 21.0 | 6.75 | 8.8 | — |
| C28AS | 30.0 | 13.5 | — | — | — | 15.75 | 11.2 | 22.5 |
| Sodium laurate | 2.5 | 9.0 | — | — | — | — | — | — |
| Zeolite A | 2.0 | 1.25 | — | — | — | 1.25 | 1.25 | 1.25 |
| Carbonate | 20.0 | 3.0 | 13.0 | 8.0 | 10.0 | 15.0 | 15.0 | 10.0 |
| Calcium carbonate | 27.5 | 39.0 | 35.0 | — | — | 40.0 | — | 40.0 |
| Sulfate | 5.0 | 5.0 | 3.0 | 5.0 | 3.0 | — | — | 5.0 |
| TSPP | 5.0 | — | — | — | — | 5.0 | 2.5 | — |
| STPP | 5.0 | 15.0 | 10.0 | — | — | 7.0 | 8.0 | 10.0 |
| Bentonite clay | — | 10.0 | — | — | 5.0 | — | — | — |
| DTPMP | — | 0.7 | 0.6 | — | 0.6 | 0.7 | 0.7 | 0.7 |
| CMC | — | 1.0 | 1.0 | 1.0 | 1.0 | — | — | 1.0 |
| Talc | — | — | 10.0 | 15.0 | 10.0 | — | — | — |
| Silicate | — | — | 4.0 | 5.0 | 3.0 | — | — | — |
| PVNO | 0.02 | 0.03 | — | 0.01 | — | 0.02 | — | — |
| MA/AA | 0.4 | 1.0 | — | — | 0.2 | 0.4 | 0.5 | 0.4 |
| SRP1 | 0.3 | 0.3 | 0.3 | 0.3 | 0.3 | 0.3 | 0.3 | 0.3 |
| Protease | — | 0.12 | — | 0.08 | 0.08 | — | — | 0.1 |
| Lipase | — | 0.1 | — | 0.1 | — | — | — | — |
| Amylase | — | — | 0.8 | — | — | — | 0.1 | — |
| Cellulase | — | 0.15 | — | — | 0.15 | 0.1 | — | — |
| PEO | — | 0.2 | — | 0.2 | 0.3 | — | — | 0.3 |
| Perfume | 1.0 | 0.5 | 0.3 | 0.2 | 0.4 | — | — | 0.4 |
| Mg sulfate | — | — | 3.0 | 3.0 | 3.0 | — | — | — |
| FRP1 | 0.3 | — | — | 0.3 | — | | 0.15 | — |
| FRP2 | — | 0.3 | — | — | 0.3– | — | | 0.15 |
| FRP3 | — | — | 0.3 | — | — | 0.3– | 0.15 | 0.15 |
| Brightener | 0.15 | 0.10 | 0.15 | — | — | — | — | 0.1 |
| Photo-activated bleach (ppm) | — | 15.0 | 15.0 | 15.0 | 15.0 | — | — | 15.0 |

It is understood that the examples and embodiments described herein are for illustrative purposes only and that various modifications or changes in light thereof will be suggested to one skilled in the art without departing from the scope of the present invention.

What is claimed is:

1. A detergent composition comprising:

a.) a fragrant reaction product, having a Dry Odor Index of more than 5, produced by the process of reacting:

(i) a primary amine compound having an Odor Intensity Index which is less than the Odor Intensity Index of a 1% solution of methylanthranilate in dipropylene glycol; and (ii) a perfume component selected from the group consisting of $C_6$–$C_{14}$ aliphatic aldehydes, $C_6$–$C_{14}$ acyclic terpene aldehydes and mixtures there of; and b.) a sufficient amount of spray dried perfume to result in said detergent having a ratio of spray dried perfume to fragrant reaction product of from about 100:1 to about 16:100.

2. A detergent composition comprising:

a.) a fragrant reaction product, having a Dry Odor Index of more than 5, produced by the process of reacting:

(i) a primary amine compound having an Odor Intensity Index which is less than the Odor Intensity Index of a 1% solution of methylanthranilate in dipropylene glycol; and (ii) a perfume component selected from the group consisting of $C_6$–$C_{14}$ aliphatic aldehydes, $C_6$–$C_{14}$ acyclic terpene aldehydes and mixtures there of; and b.) an enzyme.

3. A detergent composition comprising:

a.) a fragrant reaction product, having a Dry Odor Index of more than 5, produced by the process of reacting:

(i) a primary amine compound having an Odor Intensity Index which is less than the Odor Intensity Index of a 1% solution of methylanthranilate in dipropylene glycol; and (ii) a perfume component selected from the group consisting of $C_6$–$C_4$ aliphatic aldehydes, $C_6$–$C_{14}$ acyclic terpene aldehydes and mixtures there of; and b.) a bleach.

4. A detergent composition comprising:

a.) a fragrant reaction product, having a Dry Odor Index of more than 5, produced by the process of reacting:

(i) a primary amine compound having a boiling point of at least 125° C. and an Odor Intensity Index which is less than the Odor Intensity Index of a 1% solution of methylanthranilate in dipropylene glycol; and (ii) a perfume component selected from the group consisting of $C_6$–$C_{14}$ aliphatic aldehydes, $C_6$–$C_{14}$ acyclic terpene aldehydes and mixtures there of; and b.) a sufficient amount of spray dried perfume to result in said detergent having a ratio of spray dried perfume to fragrant reaction product of from about 100:1 to about 16:100.

5. A detergent composition comprising:

a.) from about 0.0001% to about 10% by weight of a fragrant reaction product, having a Dry Odor Index of more than 5, produced by the process of reacting:

(i) a primary amine compound having a boiling point of at least 125° C. and an Odor Intensity Index which is less than the Odor Intensity Index of a 1% solution of methylanthranilate in dipropylene glycol; and (ii) a perfume component selected from the group consisting of $C_6$–$C_{14}$ aliphatic aldehydes, $C_6$–$C_{14}$ acyclic terpene aldehydes and mixtures there of;

b.) from about 1% to about 60% by weight of a detersive surfactant;

c.) from about 0% to about 60% by weight of a detergent builder; and d.) an enzyme.

6. A detergent composition comprising:

a.) from about 0.0001% to about 10% by weight of a fragrant reaction product, having a Dry Odor Index of more than 5, produced by the process of reacting;

(i) a primary amine compound having a boiling point of at least 125° C. and an Odor Intensity Index which is less than the Odor Intensity Index of a 1% solution of methylanthranilate in dipropylene glycol; and (ii) a perfume component selected from the group consisting of $C_6$–$C_{14}$ aliphatic aldehydes, $C_6$–$C_{14}$ acyclic terpene aldehydes and mixtures there of;

b.) from about 1% to about 60% by weight of a detersive surfactant;

c.) from about 0% to about 60% by weight of a detergent builder; and d.) a bleach.

7. A detergent composition comprising:

a.) a fragrant reaction product, having a Dry Odor Index of more than 5, produced by the process of reacting:

(i) a primary amine compound having a molecular weight of at least 80 g/mol and an Odor Intensity Index which is less than the Odor Intensity Index of a 1% solution of methylanthranilate in dipropylene glycol; and (ii) a perfume component selected from the group consisting of $C_6$–$C_{14}$ aliphatic aldehydes, $C_6$–$C_{14}$ acyclic terpene aldehydes and mixtures there of; and b.) a sufficient amount of spray dried perfume to result in said detergent having a ratio of spray dried perfume to fragrant reaction product of from about 100:1 to about 16:100.

8. A detergent composition comprising:

a.) from about 0.0001% to about 10% by weight of a fragrant reaction product, having a Dry Odor Index of more than 5, produced by the process of reacting:

(i) a primary amine compound having a molecular weight of at least 80 g/mol and an Odor Intensity Index which is less than the Odor Intensity Index of a 1% solution of methylanthranilate in dipropylene glycol; and (ii) a perfume component selected from the group consisting of $C_6$–$C_{14}$ aliphatic aldehydes, $C_6$–$C_{14}$ acyclic terpene aldehydes and mixtures there of;

b.) from about 1% to about 60% by weight of a detersive surfactant;

c.) from about 0% to about 60% by weight of a detergent builder; and d.) an enzyme.

9. A detergent composition comprising:

a.) from about 0.0001% to about 10% by weight of a fragrant reaction product, having a Dry Odor Index of more than 5, produced by the process of reacting:

(i) a primary amine compound having a molecular weight of at least 80 g/mol and an Odor Intensity Index which is less than the Odor Intensity Index of a 1% solution of methylanthranilate in dipropylene glycol; and (ii) a perfume component selected from the group consisting of $C_6$ –$C_{14}$ aliphatic aldehydes, $C_6$–$C_{14}$ acyclic terpene aldehydes and mixtures there of;

b.) from about 1% to about 60% by weight of a detersive surfactant;

c.) from about 0% to about 60% by weight of a detergent builder; and d.) a bleach.

10. A detergent composition comprising:

a.) a fragrant reaction product, having a Dry Odor Index of more than 5, produced by the process of reacting:

(i) a primary amine compound having an Odor Intensity Index which is less than the Odor Intensity Index of a 1% solution of methylanthranilate in dipropylene glycol; and (ii) a perfume component selected from the group consisting of citral; neral; iso-citral; dihydro citral; cironellal; octanal; nonanal; decanal; undecanal; dodecanal; tridecanal; 2-methyl decanal; methyl nonyl acetaldehyde; 2-nonen-1-al, 2-decanal; undecenal; undecylenic aldehyde; 2,6 dimethyl octanal; 2,6,10-trimethyl-9-undecen-1-al; trimethyl undecanal; dodecenal; melonal; 2-methyl octanal; 3,5,5, trimethyl hexanal; and mixtures thereof; and b.) a sufficient amount of spray dried perfume to result in said detergent having a ratio of spray dried perfume to fragrant reaction product of from about 100:1 to about 16:100.

11. A detergent composition comprising:

a.) from about 0.0001% to about 10% by weight of a fragrant reaction product, having a Dry Odor Index of more than 5, produced by the process of reacting:

(i) a primary amine compound having an Odor Intensity Index which is less than the Odor Intensity Index of a 1% solution of methylanthranilate in dipropylene glycol; and (ii) a perfume component selected from the group consisting of citral; neral; iso-citral; dihydro citral; cironellal; octanal; nonanal; decanal; undecanal; dodecanal; tridecanal; 2-methyl decanal; methyl nonyl acetaldehyde; 2-nonen-1-al, 2-decanal; undecenal; undecylenic aldehyde; 2,6 dimethyl octanal, 2,6,10-trimethyl-9-undecen-1-al; trimethyl undecanal; dodecenal; melonal; 2-methyl octanal; 3,5,5, trimethyl hexanal; and mixtures thereof;

b.) from about 1% to about 60% by weight of a detersive surfactant;

c.) from about 0% to about 60% by weight of a detergent builder; and d.) an enzyme.

12. A detergent composition comprising:

a.) from about 0.0001% to about 10% by weight of a fragrant reaction product, having a Dry Odor Index of more than 5, produced by the process of reacting:

(i) a primary amine compound having an Odor Intensity Index which is less than the Odor Intensity Index of a 1% solution of methylanthranilate in dipropylene glycol; and (ii) a perfume component selected from the group consisting of citral; neral; iso-citral; dihydro citral; cironellal; octanal; nonanal; decanal; undecanal; dodecanal; tridecanal; 2-methyl decanal; methyl nonyl acetaldehyde; 2-nonen-1-al, 2-decanal; undecenal; undecylenic aldehyde; 2,6 dimethyl octanal; 2,6,10-trimethyl-9-undecen-1-al; trimethyl undecanal; dodecenal; melonal; 2-methyl octanal; 3,5,5, trimethyl hexanal; and mixtures thereof;

b.) from about 1% to about 60% by weight of a detersive surfactant;

c.) from about 0% to about 60% by weight of a detergent builder; and d.) a bleach.

* * * * *